US007708276B2

(12) United States Patent
Okamoto et al.

(10) Patent No.: US 7,708,276 B2
(45) Date of Patent: May 4, 2010

(54) SHEET CONVEYING PATH SWITCHING DEVICE USED IN IMAGE FORMING APPARATUS, AND SHEET CONVEYING DEVICE

(75) Inventors: Naoyuki Okamoto, Tokyo (JP); Hiroyuki Watase, Yokohama (JP); Masayuki Ueda, Tokyo (JP); Kenji Ueda, Kawasaki (JP); Yasuhiro Sagawa, Yamato (JP); Hiroshi Kajiyama, Yokohama (JP); Yoshikuni Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 101 days.

(21) Appl. No.: 11/802,985

(22) Filed: May 29, 2007

(65) Prior Publication Data

US 2008/0001350 A1 Jan. 3, 2008

(30) Foreign Application Priority Data

May 29, 2006 (JP) ..... 2006-148818
Oct. 2, 2006 (JP) ..... 2006-270578
Feb. 14, 2007 (JP) ..... 2007-032869

(51) Int. Cl.
*B65H 39/10* (2006.01)
*B65H 29/00* (2006.01)

(52) U.S. Cl. ..... 271/303; 271/185; 271/225

(58) Field of Classification Search ..... 271/303, 271/184, 186, 225, 304
See application file for complete search history.

(56) References Cited

U.S. PATENT DOCUMENTS 5,445,368 A * 8/1995 Lester et al. ..... 270/59
5,536,002 A * 7/1996 Yoshida et al. ..... 271/264
5,979,891 A * 11/1999 Roux ..... 271/225
6,176,485 B1 * 1/2001 Wingate ..... 271/303
6,474,638 B1 * 11/2002 Mylaeus et al. ..... 271/186
6,612,570 B1 * 9/2003 Cox ..... 271/279
7,080,834 B2 * 7/2006 Asari ..... 271/176
7,108,260 B2 * 9/2006 Biegelsen et al. ..... 271/303
7,185,888 B2 * 3/2007 Duff et al. ..... 271/303
7,441,770 B2 * 10/2008 Eyraud et al. ..... 271/198
2003/0080503 A1 * 5/2003 Wright et al. ..... 271/303
2008/0143042 A1 * 6/2008 Spence et al. ..... 271/225

FOREIGN PATENT DOCUMENTS

JP 10-129883 5/1998

(Continued)

OTHER PUBLICATIONS

Chinese Office Action dated Oct. 9, 2009, for corresponding patent application No. 200710103003 and English Translation.

*Primary Examiner*—Kaitlin S Joerger
(74) *Attorney, Agent, or Firm*—Harness, Dickey & Pierce, P.L.C.

(57) ABSTRACT

An easy-to-use, inexpensive, and small sheet conveying device, which can stably and separately convey not only sheets of a fixed size that are normally used, but also highly rigid sheets and special sheets, and can further separately convey a bent sheet reliably. In a sheet conveying path switching device having a sheet carrying-in path and a switching separating nail, outlines of two separating/conveying paths out of a plurality of separating/conveying paths positioned on a downstream side of the switching separating nail are configured by a movable belt surface, the two separating/conveying paths being located closer to the separating nail than the other separating/conveying paths.

19 Claims, 12 Drawing Sheets

FOREIGN PATENT DOCUMENTS

| | | |
|---|---|---|
| JP | 11-292316 | 10/1999 |
| JP | 2000-016607 | 1/2000 |
| JP | 2001-287846 | 10/2001 |
| JP | 2004-218677 | 8/2004 |
| JP | 2004-338923 | 12/2004 |
| JP | 2005-178954 | 7/2005 |

* cited by examiner

SHEET CONVEYING PATH SWITCHING DEVICE USED IN IMAGE FORMING APPARATUS, AND SHEET CONVEYING DEVICE

BACKGROUND OF THE INVENTION

1. Field of the Invention

The present invention relates to an image forming apparatus, such as a copying machine, a printer and a facsimile device. More particularly, the present invention relates to a sheet conveying path switching device for switching a sheet conveyance direction in such an image forming apparatus, and to a sheet conveying device that uses this sheet conveying path switching device.

2. Description of the Related Art

In order to downsize the whole image forming apparatus, it is desired to reduce the size of a sheet conveying device that conveys a recording sheet as a recording medium from sheet storage means such as a paper cassette or a paper feed tray. Also, in recent years, image forming apparatuses that support various sizes and types of sheets have become popular. In such image forming apparatuses, sheets of several sizes and types are previously stored in sheet storage means, and a type or size of sheet that is selected arbitrarily by a user or a sheet that is selected automatically by the image forming apparatus can be fed. For this reason, the sheet storage means fills a larger space in the image forming apparatus, thus there is a strong need of reducing the size of the sheet conveying device. From the standpoint of conveyance of sheets, the same thing is required in ADF documents as well.

Furthermore, recently, image forming apparatuses that are capable of selecting one-side printing or both-side printing of a sheet to form an image thereon have become popular. In an image forming apparatus capable of forming an image on both sides of a sheet, a sheet, one side of which has an image fixed, is sent out to a recording body loading section (sheet discharging tray) provided in the apparatus main body, or conveyed to a recording body reversing section (both-side conveying means) in order to form the image on the reverse side. Therefore, separating means for selectively switching the sheet conveyance direction is provided within the sheet conveying path. Even in the case of forming an image on one side, the conveying path needs to be switched when sheets onto which images have been fixed are sorted and discharged.

As described in, for example, Japanese Unexamined Patent Publication No. 2005-178954, there is adopted a sheet conveying device in which a simple and inexpensive separating arm is used as the separating means. In a conveying path within the sheet conveying device where a separating section is provided, the size of the conveyance direction is changed significantly, depending on the positional relation of the apparatus, and the space occupied by the conveying path is reduced in order to downsize the sheet conveying device. As a result, the conveying path is provided with a curvature section that has a predetermined curvature in order to change the conveyance direction of the conveying path continuously and smoothly, whereby the curvature radius of the curvature section can be set relatively small enough to convey a sheet of a fixed size, which is normally used in an image forming apparatus.

In the sheet conveying device having such a configuration as above, when conveying a highly rigid, firm sheet such as a cardboard, or a special type of sheet such as an envelope, the leading edge of the sheet P comes into contact with the wall surface of the curvature section due to the small curvature radius of the curvature section, whereby the friction resistance between the sheet and the wall surface increases. For this reason, there is a problem that the highly rigid sheet or special type of sheet cannot go forward along the conveying path formed in the curvature section, causing a paper jam or conveyance failure that inhibits stable conveyance operation. It is conceivable to use suction-type conveying means using air, in order to prevent such a problem described above. However, such conveying means requires a suction device, thus there is a disadvantage that the configuration of the sheet conveying device becomes complex and the size of the same increase, causing a cost increase.

In, for example, Japanese Patent Application No. 3257712, there is proposed a sheet conveying device that can securely feed sheets to each of the conveying paths intended to convey the sheets at small sheet intervals in response to the high speed of the sheet conveying device, the sheet conveying device being realized at low cost. In this sheet conveying device, as described hereinafter, by using a special switching belt, the conveying force can be applied to a sheet at a sheet-conveyance reversing section so that, even when conveying a firm sheet, smoother conveyance can be performed, compared to a fixed curving guide path having a small curvature radius. However, there is a problem in this device that a risk of a paper jam increases, as described hereinafter.

Technologies relating to the present invention are also disclosed in, e.g., Japanese Unexamined Patent Publication No. H10-129883 and Japanese Patent Application No. 3723067.

SUMMARY OF THE INVENTION

The present invention is contrived in view of the above-described background, and an object of the present invention is to provide an easy-to-use, inexpensive, and small sheet conveying path switching device and a sheet conveying device using the sheet conveying path switching device, which can stably and separately convey not only sheets of a fixed size that are normally used, but also highly rigid sheets and special sheets, and can further separately convey a bent sheet.

Another object of the present invention is to provide an image forming apparatus having the abovementioned sheet conveying device.

In an aspect of the present invention, a sheet conveying path switching device comprises a sheet carrying-in path and a switching separating arm. Outlines of two separating/conveying paths out of a plurality of separating/conveying paths positioned on a downstream side of the switching separating arm are configured by a movable belt surface, the two separating/conveying paths being located closer to the separating arm than the other separating/conveying paths.

In another aspect of the present invention, a sheet conveying path switching device comprises a sheet carrying-in path; a switching separating arm; and a plurality of separating/conveying paths disposed on a downstream side of the switching separating arm. The switching separating-arm is configured by a fixed guiding section and an end switching arm piece that is movable.

In another aspect of the present invention, a sheet conveying device comprises a sheet conveying path switching device having a sheet carrying-in path, and a switching separating arm. Outlines of two separating/conveying paths out of a plurality of separating/conveying paths positioned on a downstream side of the switching separating arm are configured by a movable belt surface, the two separating/conveying paths being located closer to the separating arm than the other separating/conveying paths.

In another aspect of the present invention, a sheet conveying device comprises a sheet conveying path switching device having a sheet carrying-in path, a switching separating arm, and a plurality of separating/conveying paths disposed on a downstream side of the switching separating arm. The switching separating arm is configured by a fixed guiding section and an end switching arm piece that is movable.

In another aspect of the present invention, an image forming apparatus comprises a sheet conveying path switching device having a sheet carrying-in path, and a switching separating arm. Outlines of two separating/conveying paths out of a plurality of separating/conveying paths positioned on a downstream side of the switching separating arm are configured by a movable belt surface, the two separating/conveying paths being located closer to the separating arm than the other separating/conveying paths.

In another aspect of the present invention, an image forming apparatus comprises a sheet conveying path switching device having a sheet carrying-in path, a switching separating arm, and a plurality of separating/conveying paths disposed on a downstream side of the switching separating arm. The switching separating arm is configured by a fixed guiding section and an end switching arm piece that is movable.

In another aspect of the present invention, a recording medium conveying device comprises an introducing path to which a recording medium is introduced; two conveying paths that are separated from the introducing path to form the shape of a letter "Y"; and a conveying path switching device that guides the recording medium from the introducing path to either one of the two conveying paths by switching a separating arm that is disposed so as to face the introducing path. Wall surface sections of the two conveying paths with which the leading edge of the recording medium introduced from the introducing path contacts are configured by a surface of a rotatable single belt that is extended to form the shape of a triangle.

In another aspect of the present invention, an image forming apparatus comprises an image forming device for forming an image on a recording medium; and a recording medium conveying device for conveying the recording medium. The recording medium conveying device comprises an introducing path to which a recording medium is introduced; two conveying paths that are separated from the introducing path to form the shape of a letter "Y"; and a conveying path switching device that guides the recording medium from the introducing path to either one of the two conveying paths by switching a separating arm that is disposed so as to face the introducing path. Wall surface sections of the two conveying paths with which the leading edge of the recording medium introduced from the introducing path contacts are configured by a surface of a rotatable single belt that is extended to form the shape of a triangle.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Before explaining the present invention hereinafter, the prior art of the present invention and the problems thereof are described with reference to the drawings.

Figure 1B:
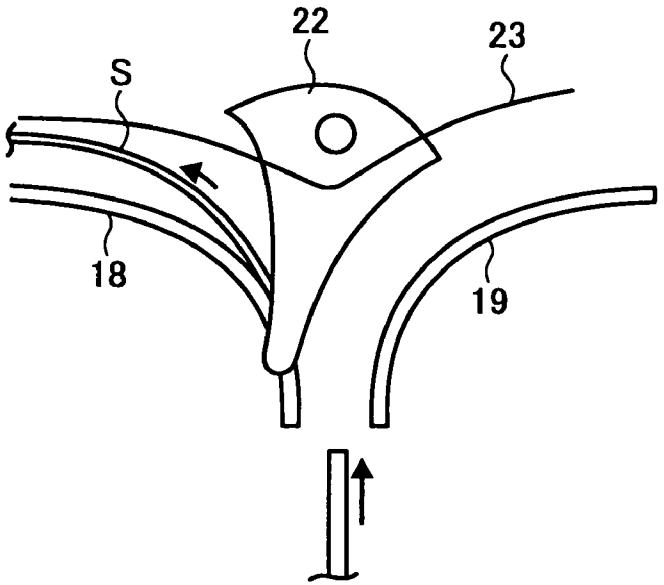
FIG. 1B PRIOR ART
FIGS. 1A and 1B are figures for explaining switching of a separating arm of a conventionally known separating device.
Figure 1A:
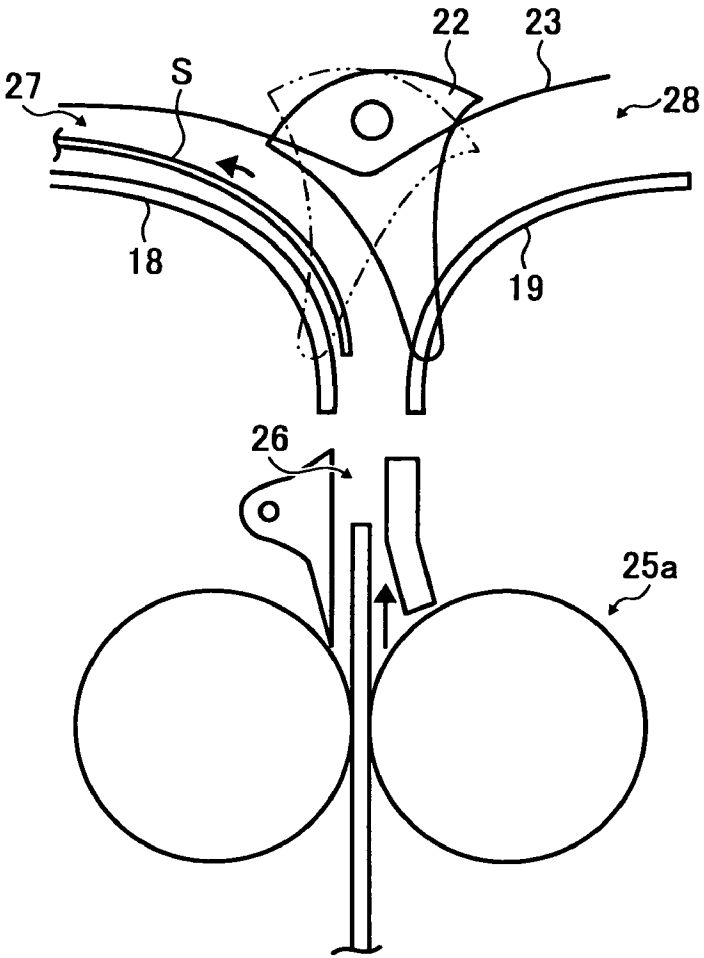
FIG. 1A PRIOR ART
Figure 2:
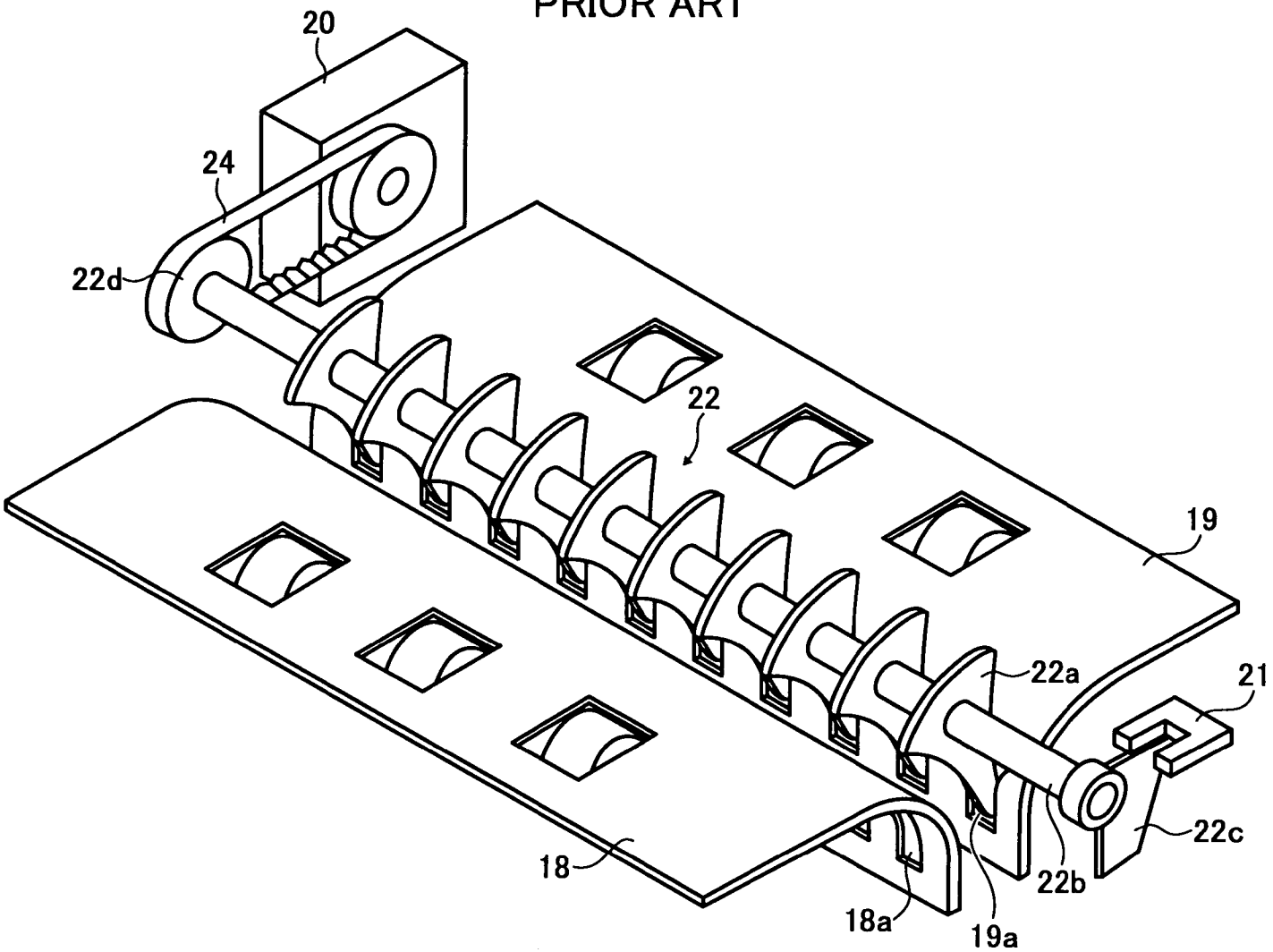
FIG. 2 PRIOR ART
FIG. 2 is an external perspective view showing a schematic configuration of the same separating device.

As already described above, FIGS. 1A and 1B each shows a schematic configuration of a sheet conveying device in which a separating arm is used as the separating means and the curvature radius of a curvature section on a separating/conveying path is small. FIG. 1A shows a first state in which the arm member of the separating arm 22 guides a sheet S to a sheet discharging tray side, while FIG. 1B shows a second state in which a sheet S is guided to a switchback conveying path and a re-conveying path side in order to perform printing on both sides of the sheet. Also, FIG. 2 shows a perspective view of the separating device. It should be noted in this figure that a guide plate 23 located on the upper side for forming a conveying path after separation and an upper roller of a pair of conveying rollers are omitted for simplification of the illustration.

As shown, the separating arm 22 is configured such that a plurality of arm members 22*a* are disposed coaxially on an axis 22*b*. Leading ends of the arm members 22*a* can fitted, respectively, into halls (may be formed into a concave shape) 18*a* and 19*a* that are provided on a lower left guide plate 18 and an lower right guide plate 19 respectively as shown in FIG. 2, whereby a conveyance direction of a sheet is separated. A shutter section 22*c* that detects a rotational position is fixed to the axis 22*b*, and an edge of the shutter section 22*c* is detected by a photosensor 21, whereby the first state in which the separating arm 22 guides a sheet to a sheet receiving section can be detected. Also, on the side opposite to the shutter section 22*c*, a pulley 22*d* is fixed to the axis 22*b*, and connected to a stepping motor 20 by means of a timing belt 24 so as to be driven by the stepping motor 20. The separating arm 22 is operated by the driving force of the stepping motor 20.

As shown in FIGS. 1A and 1B, there is provided a carrying-in path 26 to which a sheet is conveyed from a fixing device (only a pair of fixing rollers 25*a* are shown) positioned on an upstream side of the sheet conveyance direction, and there is also provided two conveying paths 27 and 28 that extend beyond the separating arm 22 and are positioned on a downstream side of the sheet conveyance direction. These conveying paths 26, 27 and 28 form a separating/conveying path. The first separating/conveying path 27 guides a sheet to the sheet receiving section side, and the second separating/conveying path 28 guides a sheet to the switchback conveying path side.

In the conventional sheet conveying device having such a configuration, as described above, when conveying a highly rigid, firm sheet such as a cardboard, or a special type of sheet such as an envelope, the leading edge of the sheet S comes into contact with the wall surface of the curvature section due to the small curvature radius of the curvature section, whereby the friction resistance between the sheet and the wall surface increases. For this reason, there is a problem that the highly rigid sheet or special type of sheet cannot go forward along the conveying path formed in the curvature section, causing a paper jam or conveyance failure that inhibits stable conveyance operation.

Figure 3A:
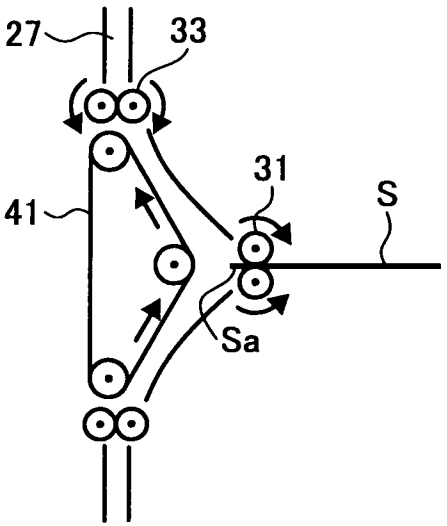
FIG. 3A PRIOR ART
FIGS. 3A through 3C are figures each showing a state in which a sheet is sent upward in another conventionally known separating device.
Figure 3B:
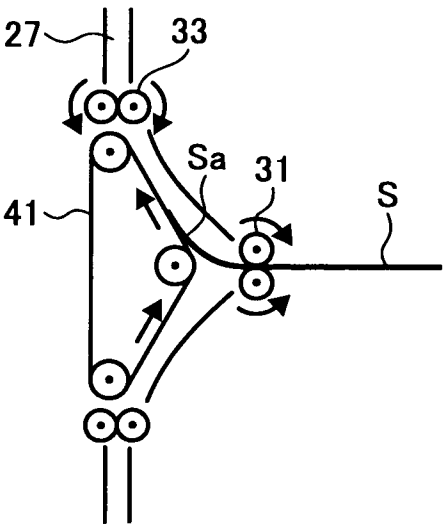
FIG. 3B PRIOR ART
Figure 3C:
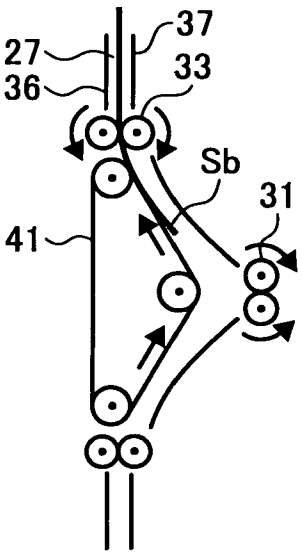
FIG. 3C PRIOR ART

In order to solve such a problem, FIGS. 3A through 3C each shows a configuration of the separating device of the sheet conveying device disclosed in the abovementioned Japanese Patent Application No. 3257712. As shown in these figures, this separating device is provided with a switching belt 41 that is located at an extension of a sheet conveyance direction of a sheet S passing through a nip between a pair of rollers 31, and is capable of rotating normally and reversely. By changing the direction of rotation of the switching belt 41, the conveyance direction of the sheet S conveyed by the pair of rollers 31 is changed.

FIG. 3A shows a state in which the leading edge of the sheet S is slightly pushed by the pair of rollers 31 toward the extension of the conveyance direction of the sheet that has passed through the nit between the rollers. At this moment, the switching belt 41 already rotates in a counterclockwise direction as shown by the arrows, in order to send the sheet S to the conveying path 27 side. When the leading edge Sa of the sheet S abuts on the switching belt 41, the leading edge Sa of the sheet S is guided to the conveying path 27 side by the switching belt 41 rotating in the direction shown by the arrows, as shown in FIG. 3B. Thereafter, the sheet S is guided to guide plates 36 and 37 as shown in FIG. 3C, sandwiched between a pair of conveying rollers 33, and then travels upward within the conveying path 27. It should be noted that a reference numeral Sb represents the rear edge of the sheet S.

Figure 4A:
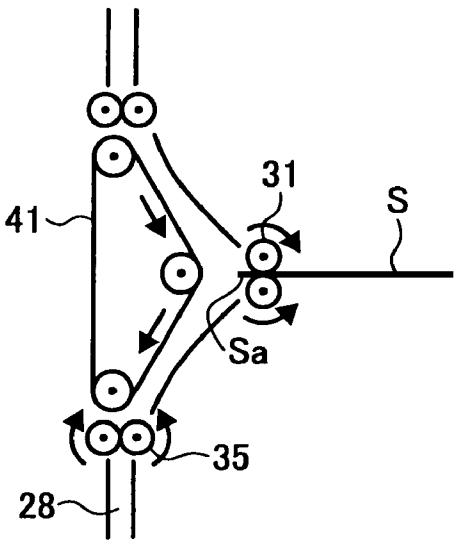
FIG. 4A PRIOR ART
FIGS. 4A through 4C are figures each showing a state in which a sheet is sent downward in the same separating device.
Figure 4B:
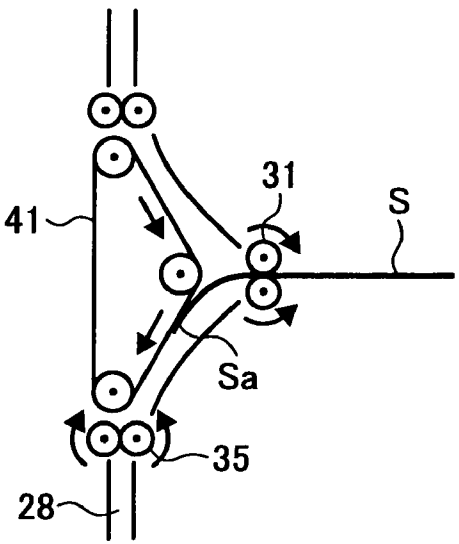
FIG. 4B PRIOR ART
Figure 4C:
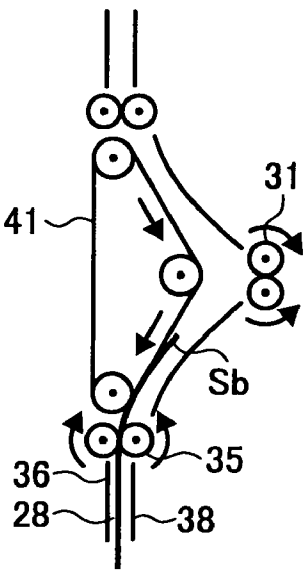
FIG. 4C PRIOR ART

In a conveyance of a sheet toward the other separating/conveying path 28, as shown in FIG. 4A, the leading edge of the sheet S is sandwiched between the pair of rollers 31, while the switching belt 41 rotates in a clockwise direction as shown by the arrows, in order to send the sheet S to the conveying path 28 side. When the sheet S reaches the switching belt 41, and the leading edge Sa abuts on the same belt, the leading edge Sa of the sheet is guided in the direction of rotation of the switching belt 41 shown by the arrows, as shown in FIG. 4B. Therefore, the sheet S is moved forward by a guide of the guide plates 36, 38, and conveyed to the lower side shown in the figure through the conveying path 28 while being sandwiched between a pair of conveying roller 35, as shown in FIG. 4C.

In this conventional sheet conveying device that has a separating device using such a switching belt described above, as already described above, the conveying force can be applied to the sheet at a sheet-conveyance reversing section so that, even when conveying a firm sheet, smoother conveyance can be performed, compared to a fixed curving guide path having a small curvature radius. However, in the configurations shown in FIGS. 3A through 3C and 4A through 4C, when sending the sheet to a desired separating/conveying path, it is not guaranteed that the leading edge of the sheet abuts on the desired separating/conveying path of the switching belt 41, thus there may occur that the sheet abuts on a section of the switching belt on a different separating/conveying path side, and then the leading edge of the sheet is pushed back to the desired separating/conveying path. In other words, since a sheet is bent or tends to bend especially after an image is fixed thereon, in the case in which the sheet S is bent downward in, for example, FIGS. 3A through 3C, the leading edge of the sheet abuts first on the lower-right diagonal side of the switching belt 41. Thereafter, the leading edge is raised as the sheet S is conveyed by the pair of rollers 31, and the sheet is pushed back to the conveying path 27 side. Therefore, the risk of a paper jam increases.

Hereinafter, each embodiment of the present invention in which the abovementioned problems of the prior art are resolved is described in detail with reference to the drawings.

First Embodiment

Hereinafter, the present embodiment is described with reference to the drawings.

Figure 5:
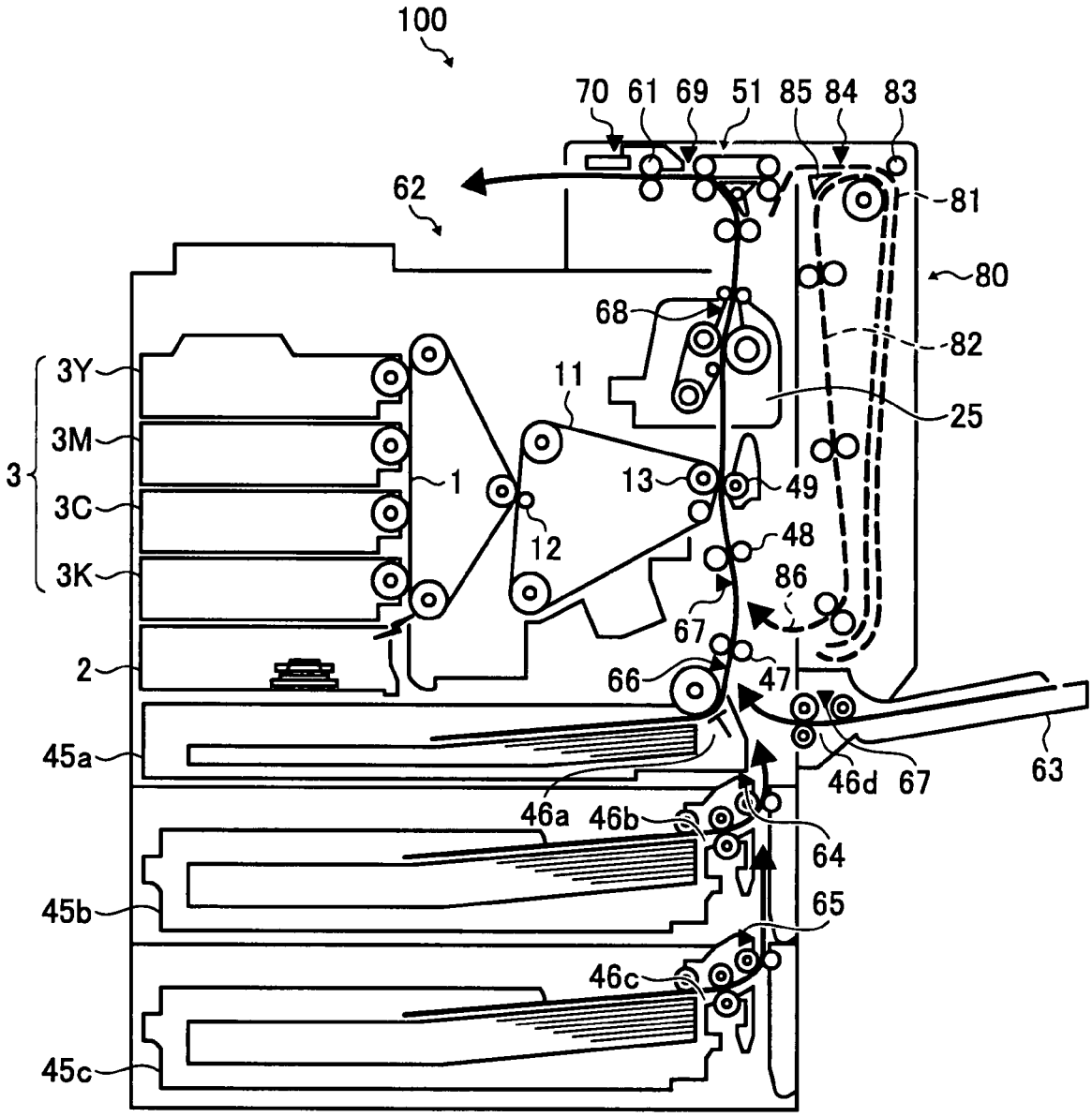
FIG. 5 is a figure showing a schematic configuration of an image forming apparatus according to a first embodiment of the present invention.

FIG. 5 shows a schematic configuration of a full-color printer (referred to as "printer" hereinafter) 100, which is an example of the image forming apparatus according to the present embodiment. This printer 100 has a belt-like photoreceptor 1 as a latent image supporting body. An unshown charging device, a writing optical unit 2 as an exposure device, a multi-stage developing unit 3 as a development device, an intermediate transfer belt 11 as a transfer device, an unshown cleaning device and the like are disposed around the photoreceptor 1.

The multi-stage developing unit 3 has, starting from the bottom, development devices 3K, 3C, 3M and 3Y storing black, cyan, magenta and yellow developers respectively, the development devices being disposed detachably in a multi-stage manner. Here, references numerals K, C, M and Y represent members for black, cyan, magenta and yellow colors respectively. Also, a primary transfer roller 12, which is primary transfer means, is provided on the inside of the intermediate transfer belt 11 so as to face the photoreceptor 1 (right side in the figure).

Furthermore, three rows of paper cassettes 45*a*, 45*b* and 45*c* each storing sheets are provided in a lower section of the printer 100. Separate feeding means 46*a*, 46*b* and 46*c* are provided so as to correspond to the paper cassettes 45*a*, 45*b* and 45*c* respectively. Moreover, a manual feed tray 63 that can be pulled out and pushed in is provided on the right-side surface of the printer 100. FIG. 5 shows a state in which the manual feed tray 63 is pulled out.

Separate feeding means 46*d* is provided in order to feed a sheet from the manual feed tray 63. A pair of grip rollers 47 are provided in order to convey sheets fed by these separate feeding means 46*a*, 46*b*, 46*c* and 46*d*.

A pair of resist rollers 48 are provided above the pair of grip rollers 47 (downstream side of the sheet conveyance direction). A secondary transfer roller 49, which is secondary transfer means, is provided above the pair of resist rollers 48 so as to face a transfer counter roller 13, which is one of the rollers around which the intermediate transfer belt 11 is wound.

It should be noted that the separate feeding means 46*a*, 46*b* and 46*c*, the pair of grip rollers 47, the pair of resist rollers 48 and the like are configured to be driven independently by a clutch, stepping motor, or the like.

A fixing device 25 is provided above the secondary transfer roller 49, and a conveying path switching device 51 that selectively separates the conveyance direction is provided above the fixing device 25. Reference numerals 64 through 70 each represents a sheet sensor disposed appropriately within each sheet conveying path. It should be noted that a sheet is appropriately guided by a guide member (no reference numeral is applied), such as a guide plate provided in each sheet conveying path. The upper surface of the printer 100 main body is configured as a sheet discharging tray 62, and a pair of discharging rollers 61 for discharging a sheet to the sheet discharging tray 62 are provided in an upper left section of the fixing device 25.

Moreover, a reversing device 80 that reverses a sheet is provided on the right side of the printer 100 main body. The reversing device 80 has a reverse forward path 81 and a reverse backward path 82 as switchback paths. There are also provided a pair of switchback rollers 83 that sandwich a sheet sent into the reverse forward path 81, an entry sensor 84 provided on an upstream side of the pair of switchback rollers 83, and a reversing unit switching arm 85.

Next, the operation of the printer is described.

When the printer receives data items of full-color images, the photoreceptor 1 rotates in a clockwise direction (right-handed direction) in FIG. 5, and the surface of the photoreceptor 1 is charged uniformly by the charging device. Next, the photoreceptor 1 is irradiated with a laser beam corresponding to the image of each color by the writing optical unit 2, whereby latent images corresponding to the respective image data items are formed on the surface of the photoreceptor. As the latent images reach the position of the multi-stage developing unit 3 by means of the rotation of the photoreceptor 1, the development devices 3K, 3C, 3M and 3Y corresponding to the respective formed colors are selectively caused to face the photoreceptor 1. Then, toner is supplied from any of the facing development devices 3K, 3C, 3M and 3Y onto the photoreceptor 1, whereby a toner image is formed. The toner image on the photoreceptor 1 is transferred once onto the intermediate transfer belt 11 by the primary intermediate transfer roller 12. On the other hand, after the toner image is transferred, the surface of the photoreceptor 1 is cleaned by the unshown cleaning device.

This cycle is repeated for all colors so that toner images yellow, magenta, cyan and black are sequentially transferred onto the intermediate transfer belt, whereby a full-color toner image having a combination of the four colors is formed.

On the other hand, a feed command is issued in accordance with timing of toner image formation, sheets are selectively fed one by one from the paper cassettes 45*a*, 45*b* and 45*c* or the manual feed tray 63 by any of the separate feeding means 46*a*, 46*b*, 46*c* and 46*d*, and each sheet reaches the pair of resist rollers 48 via the pair of grip rollers 47 and stops temporarily. The sheet is sent to a secondary transfer position by the pair of resist rollers 48 in accordance with the timing of the toner image supported on the intermediate transfer belt 11. In the secondary transfer position, the toner image supported on the intermediate transfer belt 11 is transferred onto the sheet at once by the secondary transfer roller 49.

When the sheet on which the toner image is transferred passes through the fixing device 25, the toner image is fused onto the sheet by heat and pressure. On the other hand, after the toner image is transferred, the intermediate transfer belt 11 is cleaned by an intermediate transfer belt cleaning device, which is not shown, to prepare for formation of the next electrostatic latent image.

Figure 6:
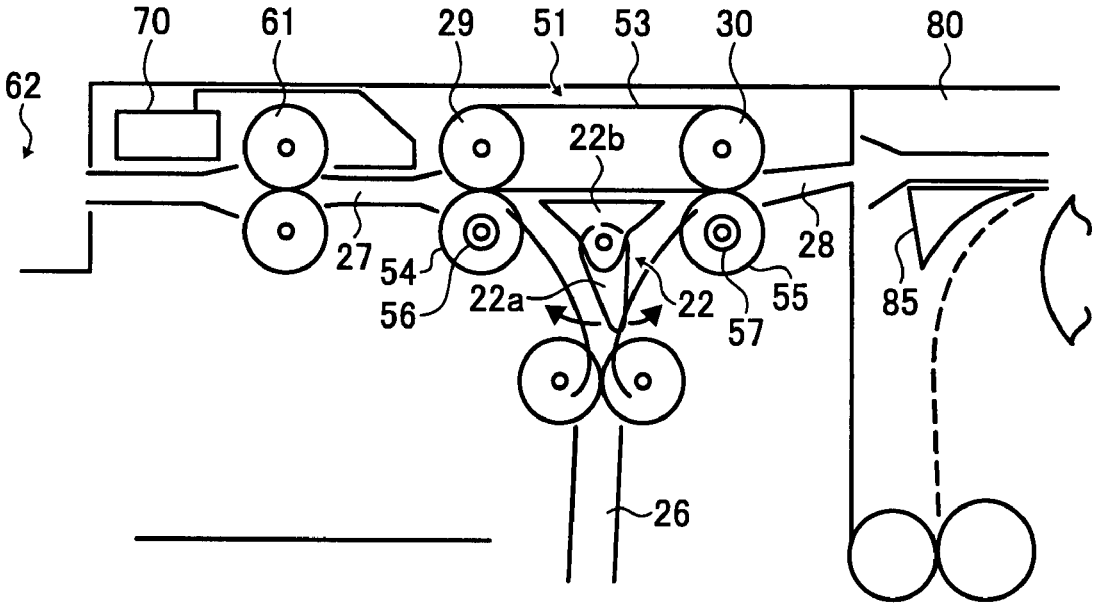
FIG. 6 is a figure showing a configuration of a sheet conveying path switching device according to the first embodiment.

The conveying path switching device 51 switches the conveyance direction of the sheet on which the toner image is fixed by the fixing device 25, so as to direct the sheet to the sheet discharging tray 62 or reversing device 80. FIG. 6 shows a schematic configuration of the enlarged conveying path switching device 51.

The conveying path switching device 51 has the separating arm 22 as sheet conveyance direction separating means, and the separating arm 22 is switched to the right or left in the figure by an actuator (not shown) such as a solenoid. The conveying path 27 conveys the sheet to the sheet discharging tray 62 side, while the conveying path 28 conveys the sheet to the reversing device 80 side.

The sheet, which is obtained after the toner image is fixed thereon by the fixing device 25, is introduced to the position of the separating arm 22 by the conveying path 26, and conveyed toward either one of the conveying paths 27 and 28 by the separating arm 22. The belt surface of an endless belt 53 serves as a part of an outline of each of the separating/conveying paths 27 and 28. Incidentally, the endless belt 53 can be divided into two parts, and these parts can also serve as an endless belt for the separating/conveying path 27 and an endless belt for the separating/conveying path 28.

The conveying path 26 and the separating/conveying paths 27 and 28 form a conveying path that is in roughly a shape of a letter "Y". For example, when one-side printing is selected, the sheet is conveyed to the conveying path 27 in the direction of the sheet discharging tray 62 by switching the separating arm 22 using the conveying path switching device 51, and the pair of discharging rollers 61 discharge the sheet to the sheet discharging tray 62 configured on the upper surface of the printer 100 main body. The heavy slid line shown in FIG. 5 each indicates a sheet conveyance passage at the time of one-side printing (when feeding from the paper cassettes 45*a*, 45*b* and 45*c* or from the manual feed tray 63).

When both-side printing is selected, the sheet is conveyed to the conveying path 28 in the direction of the reversing device 80 side by switching the separating arm 22 using the conveying path switching device 51. The sheet that is sent into the reverse forward path 81 of the reversing device 80 by the switching performed by the conveying path switching device 51 is sandwiched between the pair of switchback rollers 83, and sent to the reverse backward path 82 by a reversing operation of the switchback rollers. In the reverse forward path 81, when the entry sensor 84 provided on the upstream side of the pair of switchback rollers 83 detects the rear edge of the sheet, the directions of rotation of the switchback rollers are reversed in response to the detection, and the pair of switchback rollers 83 are driven in the reverse direction, whereby the rear edge and the front edge of the sheet are inverted, and thus obtained sheet is conveyed in a direction opposite to the entering direction. The sheet that is sandwiched between the pair of switchback rollers 83 is conveyed by the conveying operation thereof, and the reversing unit switching arm 85 is driven by the unshown solenoid. Accordingly, the sheet can enter the reverse backward path 82. The sheet that passes through the reverse backward path 82 and is inverted is conveyed to the pair of resist rollers 48 by a reverse outlet 86 in order to perform back-side printing.

The dashed lines shown in FIG. 5 represent sheet conveyance passages within the reversing device 80 at the time of both-side printing. The sheet is re-conveyed to the transfer position of the intermediate transfer belt 11 by the pair of resist rollers 48 in synchronization with the timing of toner image formation, and then the toner image is transferred. The sheet on which the toner image is transferred is conveyed to the fixing device 25, wherein the toner image is fixed onto the sheet. The sheet, the second side of which is formed with the image, is conveyed to the discharging rollers 61 by the conveying path switching device 51 through the passage shown by the heavy solid line, and then discharged onto the sheet discharging tray 62 provided outside the machine.

Further detailed configuration and operation of the conveying path switching device 51 are described.

In the printer 100 of the present embodiment, there is provided the endless belt 53 extended around two rollers 29 and 30 such that after the sheet is introduced to either one of the two conveying paths 27 and 28 by the separating arm 22, the leading edge of the sheet comes into contact with the surface of the driven belt 53 when the sheet is conveyed to the sheet discharging tray 62 or reversing device 80, and the sheet is sent in the corresponding conveyance direction.

More specifically, the leading edge of the sheet is gripped by the surface of the endless belt 53, and the conveying path switching device 51 guides the leading edge of the sheet to a sandwiching section located on a downstream side. This belt 53 is configured such that the direction of normal and reverse rotation thereof is freely switched, wherein the belt 53 is rotated in accordance with a predetermined conveyance direction in which the sheet is conveyed to the sheet discharging tray 62 or reversing device 80, thus the resistance obtained when the leading edge of the sheet comes into contact with this belt can be reduced. Therefore, not only sheets of a fixed size that are normally used, but also highly rigid sheets and special sheets can be stably conveyed without causing a paper jam or conveyance failure.

Furthermore, by providing such an extended belt, the space required for changing the direction of conveying sheets (curvature radius) can be reduced, whereby a compact printer can be obtained, inhibiting the increase of the cost.

In the illustrated example, there is configured rotating/conveying means for conveying a sheet in both directions of the sheet discharging tray 62 and reversing device 80 by means of one belt 53 whose direction of normal and reverse rotation can be freely switched, but a small endless belt can be disposed in both areas of the rollers 29 and 30, of course, so as to take charge of conveying a sheet in the direction of the sheet discharging tray 62 and the direction of the reversing device 80.

Also, a belt extending rotating member 29 can be configured as one of the pair of discharging rollers 61. In this case, an opposing rotating member 54 can be downsized, and the pair of discharging rollers 61 can be shifted to the right side in the figure, whereby a large dimension for mounting the sheet discharging tray 62 can be ensured.

As the endless belt 53, a known electrically conductive material, such as a silicone rubber with carbon black dispersed therein, is used. By using an electrically conductive material, the occurrence of frictional electrification at the abutment surface between the sheet and the belt can be prevented, and particularly an abnormal image that may be caused when performing printing on the second side can be prevented from occurring.

Furthermore, when mounting the endless belt 53 on the belt extending rotating members 29 and 30, it may be wrapped around the belt extending rotating members 29 and 30. In this case, it is preferred to obtain an extension percentage at which the leading edge of the sheet can be securely gripped by the belt surface, an extension percentage at which the linear velocity of the belt is same as that of the opposing rotating members 54 and 55 (when the belt is driven), or an extension percentage at which the belt does not interfere with the base section of the separating arm.

Moreover, by applying a driving force of a belt driving section (not shown) that can be rotary driven in both normal and reverse directions to at least one of the belt extending rotating members 29 and 30, the direction of rotation of the belt 53 can be switched between the normal direction and reverse direction.

Specifically, when conveying the sheet to the conveying path 27 on the sheet discharging tray 62 side, the direction of rotation of the belt 53 is a right-handed direction (CW) in the figure, and when the sheet is conveyed to the conveying path 28 on the reversing device 80 side, the direction of rotation of the belt 53 is a left-handed direction (CCW) in the figure. Alternatively, by applying the driving force of the driving section to the rotating members 54 and 55 facing the belt extending rotating members 29 and 30 via the belt 53, the belt 53 may be driven and rotated.

Torque limiters 56 and 57 may be provided on such rotating member driving section or the opposing rotating members 54 and 55. That way, the belt 53 can be securely switched so that the sheet is conveyed to different conveying paths, and the belt 53 can be prevented from being damaged even when a trouble such as a paper jam occurs. Furthermore, the conveying paths can be easily opened so as to release the sandwiching state between the belt 53 and the opposing rotating members 54 and 55.

It should be noted that, by disposing the rotating members 54 and 55 in positions facing the rotation axis of the belt 53, the sheet is sandwiched and conveyed regardless of which one of the belt extending rollers 29 and 30 and opposing rotating members 54 and 55 is applied with the driving force, thus the friction resistance between the belt 53 and the sheet increases, improving the sheet conveying performance.

The separating arm 22 is constituted by a movable end switching arm piece 22*a* and a fixed guiding section 22*b*. By providing the movable section and a fixed section, even when the bottom section of the fixed guiding section 22*b* is brought extremely close to the belt 53, the base section of the separating arm does not come into contact with the belt surface when the sheet conveyance passage is switched, thus the sheet can be guided securely. By bending a side of the fixed guiding section 22*b* to form a curvature section of each separating/conveying path, the sheet can be conveyed smoothly.

Figure 7:
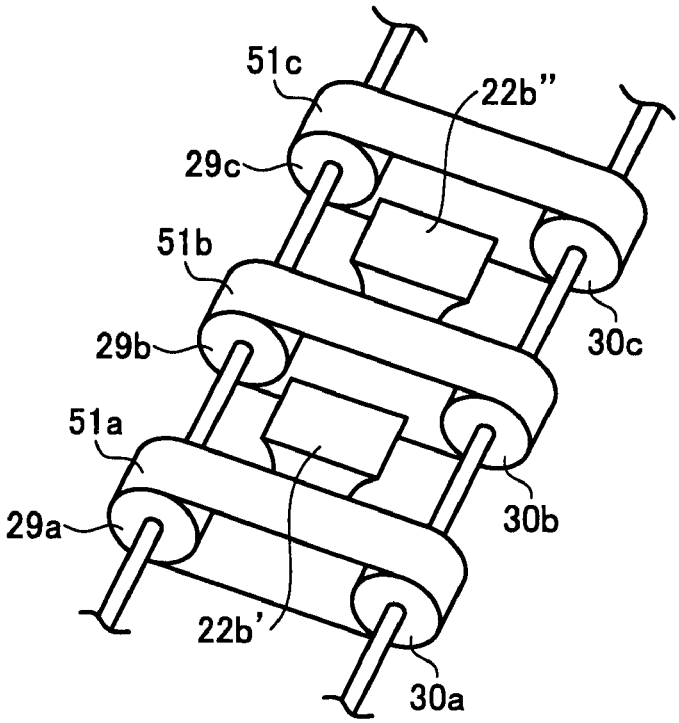
FIG. 7 is a perspective view showing a state in which an endless belt is divided in a direction perpendicular to a sheet conveyance direction.

As shown in FIG. 7, the belt 51 may be divided into a plurality of parts in a direction perpendicular to the sheet conveyance direction. By dividing the belt, fixed guiding sections 22*b*', 22*b*" can be disposed between partial belts 51*a*, 51*b* and 51*c* (the figure shows only three belt pieces, but the number of the partial belts can be two, four or more). By disposing these sections, the bottom section of each fixed guiding section (the flat section of each fixed guiding section shown in FIG. 7) can be positioned above a lower side surface of each of the partial belts 51*a*, 51*b* and 51*c*, and the separating arm 22 can be inserted into the area of the endless belt. Such configuration allows the sheet to be guided smoothly from the side of the fixed guiding section to the belt surface.

The operation of switching the separating arm 22 (movable end switching arm piece 22*a*) is performed prior to the operation of switching the direction of rotation of the belt 53. By doing so, the sheet can be securely guided to different conveying paths without increasing a sheet conveying interval.

Figure 8:
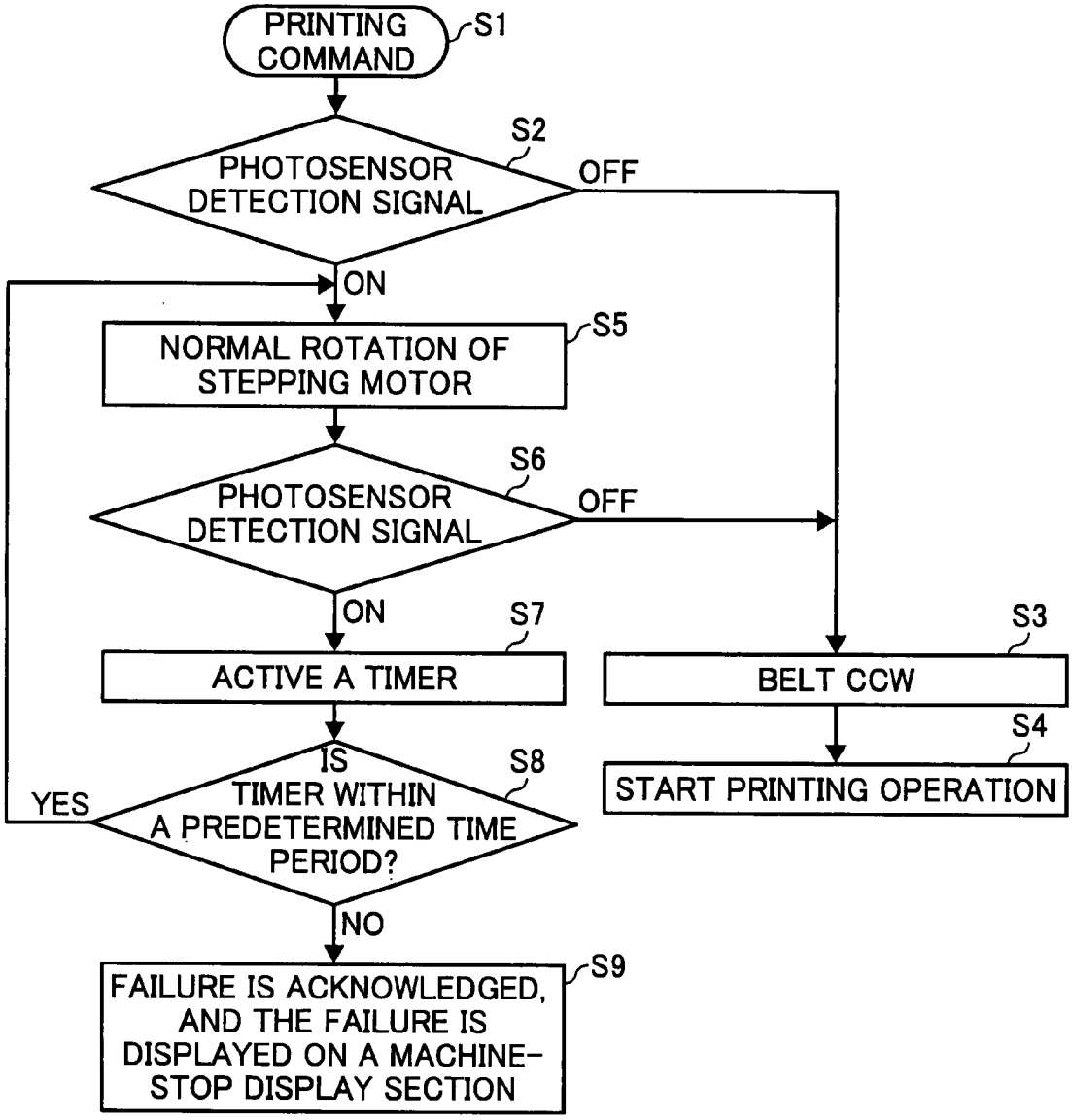
FIG. 8 is a flowchart for explaining the timing to drive a separating arm and belt.

FIG. 8 is a flowchart of an example of the operations of the separating arm 22 and the endless belt 53.

In a controller (not shown) within the printer 100 main body, when a both-side printing command is inputted (step S1), the detection state of the photosensor (not shown but corresponding to the reference numeral 21 shown in FIG. 2) of the separating arm is checked (step S2). When the detection state is OFF, the end switching arm opens the separating/conveying path 28 through which the sheet is conveyed to the reversing device 80, and thus rotates the endless belt 53 in the left-handed direction in FIG. 2 (step S3) while keeping the position of the end switching arm (e.g., stepping motor excitation), and thereafter printing operation is started (step S4).

If, on the other hand, the detection state of the photosensor is ON in the step S2, the end switching arm opens the separating/conveying path 27 through which the sheet is conveyed to the sheet discharging tray 62, and closes the separating/conveying path 28 through which the sheet is conveyed to the reversing device 80, thus the stepping motor (not shown but corresponding to the reference numeral 20 in FIG. 2) is rotated normally until the detection state becomes OFF (steps S5 and S6). Then, a timer or the like is used to weigh the time (step S7). When the detection state is not switched to OFF within predetermined time period (step S8), there is a possibility that a part is broken, thus the operation of the image forming apparatus is stopped, and such trouble is displayed by an operating section or the like, which is not shown (step S9).

As described above, according to the present embodiment, by configuring the rotatable belt 53 with which the leading edge of the sheet comes into contact at a section between the separating arm 22 and the two conveying paths 27 and 28, a load that is caused when the leading edge of the sheet and the belt abut on each other can b reduced significantly. Therefore, not only sheets of a fixed size that are normally used, but also highly rigid sheets and special sheets can be stably conveyed without causing a paper jam or conveyance failure.

Figure 9:
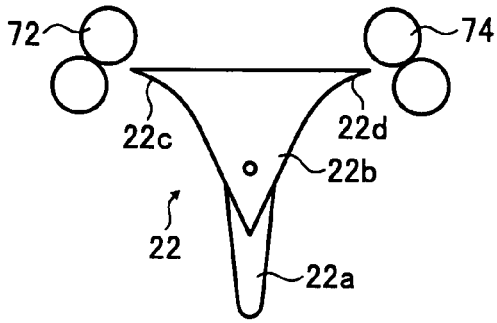
FIG. 9 is a figure showing a modification of the same sheet conveying path switching device.

In a modification of the present embodiment, as shown in FIG. 9, pairs of sandwiching rollers 72 and 74 are disposed in the vicinity of both ends of the base section of the fixed guiding section of the separating arm 22 configured by the movable end switching arm piece 22*a* and the fixed guiding section 22*b*. Moreover, base vertex angle sections 22*c* and 22*d* of the fixed guiding section 22*b* are formed into a shape such that the leading edge of the sheet is guided to the sandwiching sections of the pairs of sandwiching rollers 72 and 74. By providing such a configuration, the sheet can be guided smoothly.

Moreover, by configuring the separating arm 22 with the fixed guiding section 22*b* and the movable end switching arm piece 22*a*, the base vertex angle sections 22*c* and 22*d* can be brought close to the sandwiching rollers 72 and 73 on the outline side of the fixed guiding section 22*b* as much as possible without considering the rotation area of the separating arm (specifically, in the case of a conventional separating arm that has a guide surface extending to the vicinity of a pair of sandwiching rollers 72 and 74 in order to easily guide a sheet to the pair of sandwiching rollers 72 and 74, an end on a downstream side of the arm interferes with the inner guide when the arm rotates, thus there is a risk that the sheet conveying paths may be closed), whereby the sheet can be guided smoothly. In other words, in the case of the conventional configuration, there is a difference in level between the base section of the switching arm and the outline guide that generates a load, but such a level difference can be eliminated in the above-mentioned configuration, as a result of which the load of conveyance can be reduced.

It should be noted in this case that a plurality of the fixed guiding sections 22*b* and movable end switching arm pieces 22*a* may be disposed in the direction perpendicular to the sheet conveyance direction, as with the embodiment shown in FIG. 2. With this configuration, the pair of sandwiching rollers 72 and 74 and the pair of base vertex angle sections 22*c* and 22*d* can be disposed alternately in a width direction. With this configuration, a difference in level between the pair of sandwiching rollers 72 and 74 and the pair of base vertex angle sections 22*c* and 22*d* in the conveyance direction can be eliminated, preventing the leading edge of the sheet from colliding with the sides of the pair of sandwiching rollers 72 and 74. As a result, the sheet can be guided smoothly to the sandwiching section between the pair of sandwiching rollers 72 and 74.

In the present embodiment, the conveying path switching device 51 is disposed in the vicinity of the base section of the separating arm, thus the conventional separating arm interferes with the belt 53 when the separating arm rotates. Therefore, by disposing the conventional separating arm between the belts in the same manner in place of the fixed guiding sections 22*b*', 22*b*" described with reference to FIG. 7, interference between the separating arm and the belts can be prevented.

It should be noted that the present embodiment describes the sheet switching position (the sheet discharging tray and the both-side reversing path) obtained after fixing the toner image, but the present invention is not limited to this embodiment. For example, the image forming apparatus can be applied to a draft conveying path switching position of an automatic draft feeder (ADF) for conveying and reading a draft, a switching position when discharging a sheet having an image formed thereon to a plurality of loading sections, and a separating position at which the conveying paths are divided into two or more. Moreover, the image forming apparatus may have a configuration in which a loading space is formed between an image reading section and an image forming section, and the image forming section can be applied not only to an apparatus of electrophotographic type or various other types.

According to the present embodiment, the following effects can be obtained.

(1) In the sheet conveying path switching device having a sheet carrying-in path and a switching separating arm, the outlines of the two separating/conveying paths out of a plurality of separating/conveying paths positioned on the downstream side of the switching separating arm are configured by a movable belt surface, the two separating/conveying paths being located closer to the separating arm than the other separating/conveying paths. Therefore, not only sheets of a fixed size that are normally used, but also highly rigid sheets and special sheets can be stably conveyed, and even bent sheets can be conveyed securely.

(2) Since the outlines of the two separating/conveying paths are configured with the belt surface of a single endless belt, a simple configuration can be obtained.

(3) The rotating member that faces the belt extending rotating member is disposed on an inner rim of each separating/conveying path, and the sheet is sandwiched between the opposing rotating member and the belt surface and then conveyed, whereby the applied pressure onto the belt can be adjusted without relaying on the tension of the belt, or particularly the friction resistance force can be adjusted, whereby the sheet can be conveyed securely.

(4) A drive may be applied directly to the belt extending rotating member to stably drive the belt. If the belt that is capable of rotating normally and reversely is drive by driving the opposing rotating member, it is not necessary to dispose a driving member on a belt rotation axis located on an outer rim of the sheet conveying path, which is an advantage in terms of the layout, whereby the number of parts can be reduced.

(5) Since one of the belt extending rotating members serves as one of the pair of discharging rollers, the sheet conveyance characteristics of the sheet discharge/conveyance can be securely improved simply by increasing the length of the belt.

(6) The opposing rotating members are provided with the torque limiters. Therefore, in the case in which weight that exceeds the weight tolerated by the conveying members is applied to each conveying member provided in the conveying path switching device due to a paper jam or the like, the drive of the opposing rotating member is stopped. Accordingly, the weight applied to the belt can be kept within the range of the tolerated weight to prevent the belt from being damaged, whereby a sheet conveying device that is hardly broken can be provided (7) Since the belt is electrically conductive, frictional electrification can be prevented from occurring at the abutment surface, whereby an abnormal image that may be caused when performing printing on the second side can be prevented from occurring.

(8) Since the switching separating arm is constituted by the fixed guiding section and the movable end switching arm piece, the function of switching the conveying paths and the function of reversing the conveyance direction can be provided for each section. Even if the curvature of each side of the fixed guiding section is increased, and the sheet conveying paths are switched compactly, the leading edge of the sheet slides on each side of the fixed guiding section, preventing the occurrence of a conveyance failure.

(9) The base section of the fixed guiding section is brought as close as possible to the belt surface configuring the outlines of the separating/conveying paths, thus the sheet to be conveyed from each side of the fixed guiding section to the belt surface can be conveyed smoothly.

(10) The endless belt is constituted by a plurality of belt sections that are obtained in the direction perpendicular to the sheet conveyance direction, thus the cost of these members can be cut.

(11) The base section of the fixed guiding section can be disposed in the area of the endless belt, closer than the belt surface configuring the outlines of the separating/conveying paths, whereby the sheet to be conveyed from each side of the fixed guiding section to the belt surface can be conveyed more smoothly.

(12) The operation of switching the separating arm is performed prior to the operation of switching the direction of rotation of the belt, thus, in a state in which sheets are continuously enter the carrying-in path, the sheets can be securely guided from the carrying-in path to either one of the separating/conveying paths even in a case in which the sheet intervals are small. Thus a sheet conveying device having an excellent productivity can be provided.

(13) In the sheet conveying path switching device that has the sheet carrying-in path, switching separating arm, and a plurality of separating/conveying paths located on the downstream side of the switching separating arm, the switching separating arm is constituted by the fixed guiding section and the movable end switching arm piece, thus not only sheets of a fixed size that are normally used, but also highly rigid sheets and special sheets can be stably conveyed, and even bent sheets can be conveyed securely.

(14) By disposing the pair of sandwiching rollers in the vicinity of both ends of the base of the fixed guiding section, and by causing the base vertex angle sections to face a roller of the pair of sandwiching rollers that configures the outline of the separating/conveying paths, the risk of occurrence of a paper jam can be further prevented.

Second Embodiment

Next, the present embodiment is described with reference to the drawings.

Figure 10:
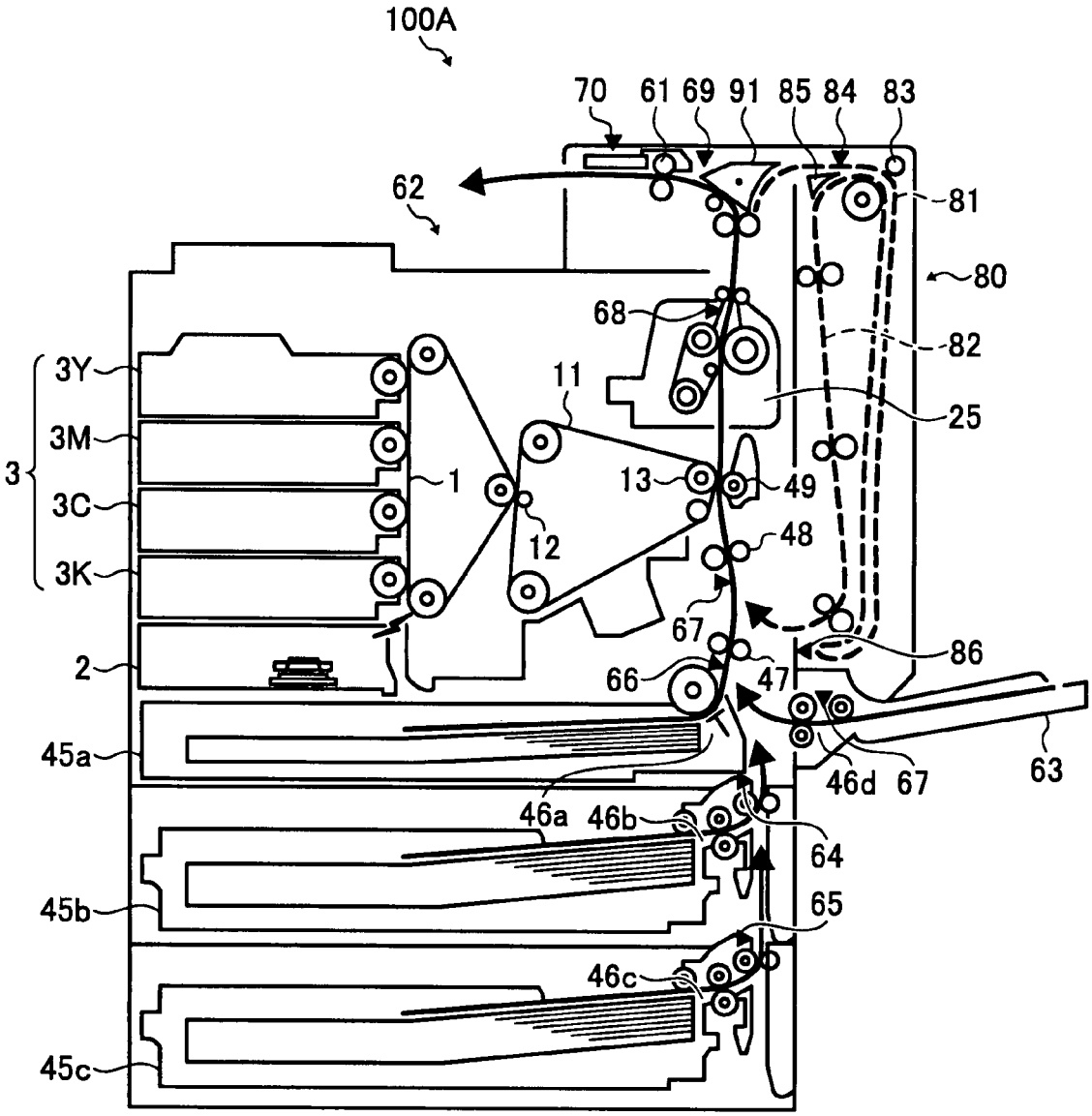
FIG. 10 is a figure showing a schematic configuration of the image forming apparatus according to a second embodiment of the present invention.

FIG. 10 shows a schematic configuration of a full-color printer 100A, which is an example of the image forming apparatus according to the present embodiment. As shown, the printer 100A is substantially the same as the printer 100 according to the above-described first embodiment shown in FIG. 5, except that the conveying path switching device 51 is configured differently. Therefore, repeated descriptions are omitted hereinafter, and mainly the configuration and operation of a conveying path switching device 91 of the present embodiment are described with reference to the drawings.

Figure 11:
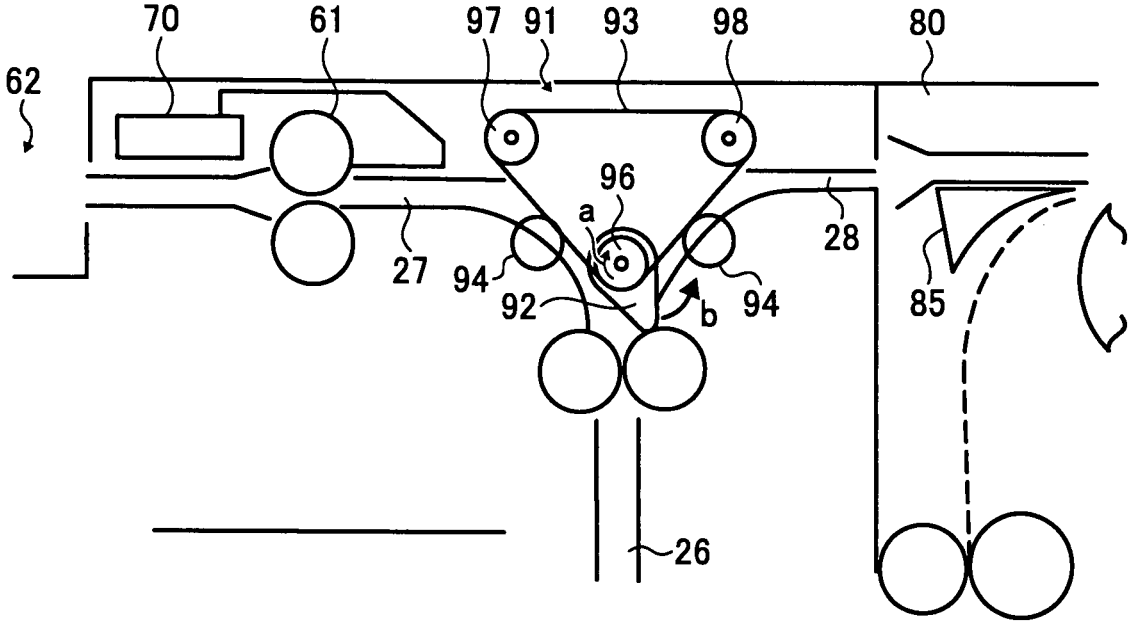
FIG. 11 is a figure showing a schematic configuration of the sheet conveying path switching device according to the second embodiment.

The conveying path switching device 91 of the present embodiment switches the conveyance direction of a recording sheet obtained after a toner image is fixed thereon by the fixing device 25, to guide the recording sheet to the sheet discharging tray 62 or the reversing device 80. FIG. 11 shows a schematic configuration of the conveying path switching device 91.

The conveying path switching device 91 has the separating arm 92 as recording medium conveyance direction separating means, and the separating arm 92 is switched to the right or left in the figure by an actuator (not shown) such as a solenoid. The conveying path 27 conveys the recording sheet to the sheet discharging tray 62 side, while the conveying path 28 conveys the recording sheet to the reversing device 80 side.

The recording sheet, which is obtained after the toner image is fixed thereon by the fixing device 25, is introduced to the position of the separating arm 92 by the introducing path 26, and conveyed toward either one of the conveying paths 27 and 28 in a shape of a letter "Y" by the separating arm 92. For example, when one-side printing is selected, the recording body is conveyed to the conveying path 27 in the direction of the sheet discharging tray 62 by switching the separating arm 92 using the conveying path switching device 91, and the pair of discharging rollers 61 discharge the recording body to the sheet discharging tray 62 configured on the upper surface of the printer 100A main body. The heavy slid line shown in FIG. 10 each indicates a sheet conveyance passage at the time of one-side printing (when feeding from the paper cassettes 45*a*, 45*b* and 45*c* or from the manual feed tray 63).

When both-side printing is selected, the recording sheet is conveyed to the conveying path 28 in the direction of the reversing device 80 side by switching the separating arm 92 using the conveying path switching device 91. The recording sheet that is sent into the reverse forward path 81 of the reversing device 80 by the switching performed by the conveying path switching device 91 is sandwiched between the pair of switchback rollers 83, and sent to the reverse backward path 82 by a reversing operation of the switchback rollers. In the reverse forward path 81, when the entry sensor 84 provided on the upstream side of the pair of switchback rollers 83 detects the rear edge of the recording sheet, the directions of rotation of the switchback rollers are reversed in response to the detection, and the pair of switchback rollers 83 are driven in the reverse direction, whereby the rear edge and the front edge of the recording sheet are inverted, and thus obtained recording sheet is conveyed in a direction opposite to the entering direction. The recording sheet that is sandwiched between the pair of switchback rollers 83 is conveyed by the conveying operation thereof, and the reversing unit switching arm 85 is driven by the unshown solenoid. Accordingly, the recording sheet can enter the reverse backward path 82. The recording sheet that passes through the reverse backward path 82 and is inverted is conveyed to a pair of resist rollers 49 by a reverse outlet 86 in order to perform back-side printing.

The dashed lines shown in FIG. 10 represent recording body conveyance passages within the reversing device 80 at the time of both-side printing. The sheet is re-conveyed to the transfer position of the intermediate transfer belt 11 by the pair of resist rollers 49 in synchronization with the timing of toner image formation, and then the toner image is transferred. The sheet on which the toner image is transferred is conveyed to the fixing device 25, wherein the toner image is fixed onto the sheet. The sheet, the second side of which is formed with the image, is conveyed to the discharging rollers 61 by the conveying path switching device 91 through the passage shown by the solid line, and then discharged onto the sheet discharging tray 62 provided outside the machine.

Moreover, in the printer 100A of the present embodiment, a wall surface, with which the leading edge of the recording sheet comes into contact at a section between the separating arm 92 and the two conveying paths 27 and 28, is extended to form a triangular shape by three rollers 96, 97 and 98 to form a rotatable belt 93. This belt 93 is configured rotatably, thus even when the leading edge of the recording sheet comes into contact with this belt, the surface of the belt 93 can be moved in the recording body conveyance direction by the rotation of the belt 93. Accordingly, the conveyance load that is caused when the leading edge of the recording sheet comes into contact with the wall surface of one of the two conveying paths 27 and 28 can be reduced. Therefore, not only sheets of a fixed size that are normally used, but also highly rigid sheets and special sheets can be stably conveyed without causing a paper jam or conveyance failure. By simply providing the belt that is extended to form a triangle, an easy-to-use sheet conveying path switching device can be provided in a small space, inhibiting the increase of the cost.

As the material of the belt 93, an electrically conductive member, such as a silicone rubber with carbon black dispersed therein, is preferably used. By using an electrically conductive member, the occurrence of frictional electrification at the abutment surface between the recording sheet and the belt can be prevented. Particularly an abnormal image that may be caused by the frictional electrification when performing printing on the second side can be prevented from being generated.

Also, the belt 93 is provided with a belt driving section M that can be rotary drive in both normal and reverse directions, and this belt driving section M is rotary driven when the recording sheet is conveyed in the different directions of the two conveying paths 27 and 28. Specifically, when conveying the recording sheet to the conveying path 27 on the sheet discharging tray 62 side, the direction of rotation of the belt 93 is a right-handed direction (CW) in the figure, and when the recording sheet is conveyed to the conveying path 28 on the reversing device 80 side, the direction of rotation of the belt 93 is a left-handed direction (CCW) in the figure. By rotary driving the belt 93 in this manner, the recording sheet conveying performance can be improved, whereby the recording sheet can be conveyed more stably. Moreover, the operation of switching the separating arm 92 is performed in synchronization with the operation of switching the direction of rotation of the belt 93, whereby the recording sheet can be securely guided to different conveying paths. In addition, by providing a torque limiter in the belt driving section M, the direction of rotation of the belt 93 can be securely switched so that the recording sheet is conveyed to different conveying paths.

A pair of turn rollers 94 that are driven in order to sandwich and convey the recording sheet may be disposed in a position facing the belt 93. By providing such a turn roller 94, the friction resistance between the belt 93 and the recording sheet increases, and the recording sheet conveying performance is improved. Furthermore, the turn roller 94 is made of a material that slides easily, such as a polyacetal, whereby even if there is generated the difference between a frictional coefficient between the turn roller 94 and the surface of the recording sheet and a frictional coefficient between the belt 93 and the back of the recording sheet, or even if there is generated the speed difference between turn roller 94 and the belt 93 due to a tolerance caused by assembling the components, the risk of the occurrence of rubbing and the like between the turn roller and the recording sheet can be lowered.

Figure 12:
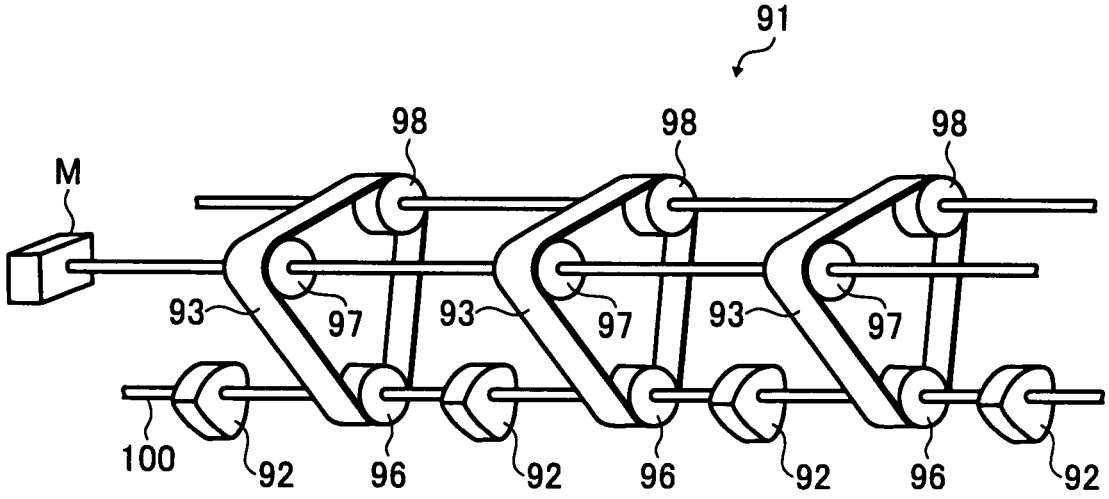
FIG. 12 is an external perspective view showing a schematic configuration of the conveying path switching device.

FIG. 12 shows a schematic configuration of the conveying path switching device 91. The operation of the conveying path switching device 91 is described in further detail with reference to FIG. 12. It should be noted in FIG. 12 that the turn roller 94 is not provided.

The belt 93 is extended to form a triangle by the rollers 96, 97 and 98, and this belt is divided into a plurality of sections in a direction perpendicular to the sheet conveyance direction. The roller 97 is connected to the belt driving section M capable of being rotary driven in both normal and reverse directions, and rotates in a direction corresponding to a change in the rotation direction of the belt driving section M to rotary drive the belt 93 in a horizontal direction. The rollers 96 and 98 are pivotally supported so as to follow the rotation of the belt 93 caused by the rotation of the roller 97. In FIG. 12, the roller 97 is driven, but the roller 98 may be driven or both rollers 97 and 98 may be driven. Accordingly, the belt surface in the sheet entering direction is stretched by the driven rollers, whereby the leading edge of the recording sheet securely comes into contact with the belt surface, improving the conveying performance. Therefore, the recording sheet can be conveyed stably to either one of the two conveying paths 27 and 28.

Also, as with the belt 93, the separating arm 92 is divided into a plurality of parts in the direction perpendicular to the sheet conveyance direction. In order to prevent skew from occurring when the leading edge of the recording sheet reaches the plurality of separating arms 92, the separating arms 92 are preferably disposed in the vicinity of the center of the recording sheet conveyance direction or in positions symmetrical with respect to the center of the recording sheet conveyance direction. Therefore, the separating arms 92 are disposed, respectively, in rotation axes 100 of the rollers 96 extending the belt 93, so as to be alternate with the rollers 96, whereby the separating arms are rotatably supported in the horizontal direction.

Here, the direction of rotation of each roller 96 is opposite to the direction of rotation of each separating arm 92 with respect to the rotation axis 100. Specifically, as shown in FIG. 11, when the recording sheet is conveyed to the conveying path 27 on the sheet discharging tray 62 side, the roller 96 is rotated in the right-handed direction (direction of a in the figure) with respect to the rotation axis 100 in order to rotate the belt 93 in the right-handed direction (CW) by means of the belt driving section M, and the separating arm 92 is rotated in the left-handed direction (direction of b in the figure) with respect to the rotation axis 100 in order to shift the leading edge of the recording sheet to the right.

Hereinafter, a mechanism for rotating the roller 96 and the separating arm 92 in opposite directions is described.

Figure 13:
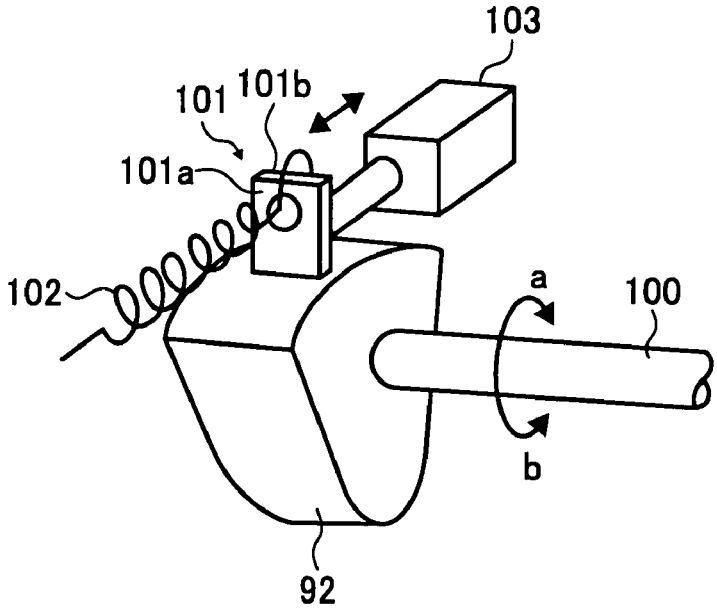
FIG. 13 is an external perspective view showing a schematic configuration of the separating arm.

FIG. 13 shows a schematic configuration of the separating arm 92 supported by the rotation axis 100. As shown in FIG. 13, the separating arm 92 is supported so as to slide easily with respect to the rotation axis 100, so that the rotation of the roller 96 is not transmitted to the separating arm 92 via the rotation axis 100 or the load applied to the rotation axis 100 is not increased by the operation of rotating the separating arm 92. An upper section of the separating arm 92 is provided with a convex section 101 in which the near side and far side in the figure form flat surfaces 101*a* and 101*b* respectively. The near-side flat surface 101*a* of the convex section 101 is provided with an elastic member 102 that is biased from the near side toward the far side, and the far-side flat surface 101*b* is provided with a solenoid 103. In such a configuration, the separating arm 92 can be rotated in the right-handed and left-handed directions with respect to the rotation axis 100 by an on/off operation of the solenoid 103 and a change in the biasing force of the elastic member 102 in response to the on/off operation. The on/off operation of the solenoid 103 is performed at the same time that the operation of switching the direction of rotation of the belt 93 is performed. Specifically, in response to a pulse obtained when the direction of rotation of the belt driving section M is changed, whether to turn on or off the solenoid 103 is determined. With this configuration, the separating arm 92 can be shifted in the direction opposite to the direction of rotation of the belt 93, whereby the leading edge of the recording sheet can be stably guided to either the conveying path 27 or 28.

Figure 14A:
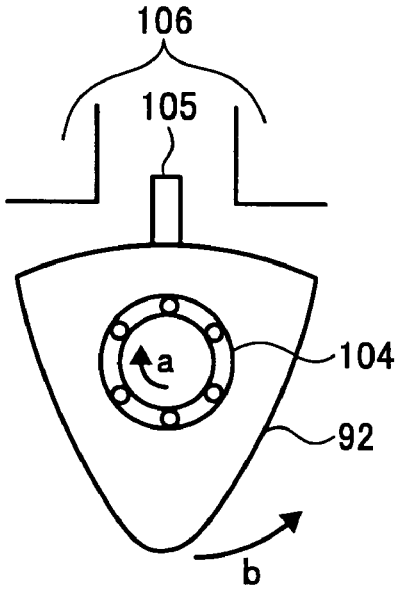
FIGS. 14A and 14B are figures each showing a schematic configuration of the separating arm according to a modification.
Figure 14B:
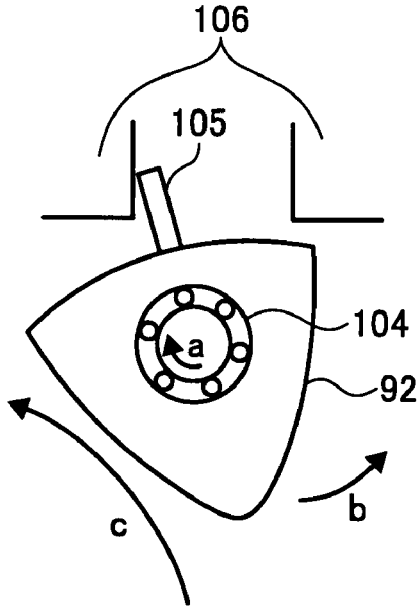

FIGS. 14A and 14B each shows a schematic configuration of another example of a mechanism that rotates the roller 98 and the separating arm 92 in opposite directions. As shown in FIGS. 14A and 14B, a plurality of rotating members 104 are disposed between the separating arm 92 and the outer circumference of the rotation axis 100. The upper part of the separating arm 92 is provided with a convex section 105, and the horizontal direction of the convex section 105 is provided with regulating sections 106 that abut on the convex section 105 when the separating arm 92 is shifted in the right-handed and left-handed directions, and regulates the shifting. In such a configuration, when the rotation axis 100 rotates in the right-handed direction (direction of the arrow a) as shown in FIG. 14A, the separating arm 92 is rotated by the rotating member 104 in the left-handed direction (direction of the arrow b), which is opposite to the direction of rotation of the rotation axis 100. Then, the separating arm 92 rotates in the direction of the arrow b, the shifting of the separating arm 92 is regulated when the convex section 105 abuts on the regulating section 106 as shown in FIG. 14B, and the separating arm 92 stops at this position. In this manner, the separating arm 92 rotates in the direction of the arrow b so that the leading end thereof is shifted, whereby the conveying path 27 side is opened, the belt 93 is rotated in the direction of the arrow a, and the recording sheet is conveyed in a direction of the arrow c. It should be noted that the position where the separating arm 92 is regulated is preferably located in a position where the leading edge of the recording sheet can enter at an acute angle with respect to the belt 93.

Also, as shown in FIG. 11, the distance between the rotation axis 100 and the outer circumference of the separating arm 92 is made larger than the external diameter of the roller 96, and the outer circumference of the separating arm 92 extends to the outside of the outer circumference of the roller 96 in the vicinity of the rotation axis. Accordingly, the outer circumference of the separating arm 92 prevents the leading edge of the recording sheet from entering an area of contact between the belt 93 and the roller 96, whereby the leading edge of the recording sheet enters the belt surface other than the area of contact between the belt and the roller 96. The belt surface other than the area of contact between the belt and the roller 96 can securely grip the leading edge of the recording sheet by means of elastic deformation of the belt 93, thus the recording sheet can be conveyed to the conveying path 27 or 28 more stably.

It should be noted that FIGS. 13, 14A and 14B describe that the position where the separating arm 92 rotates is regulated by the convex section provided in the upper section of the separating arm 92, but the present invention is not limited to this embodiment. For example, when the separating arm 92 is rotated in the right-handed or left-handed direction without providing the convex section, the area below the rotation axis in the separating arm 92 may be caused to abut on a conveying guide to regulate the abovementioned position.

Furthermore, the relationship between the separating arm 92 and the rotation axis 100 is not limited to the above configuration, thus a mechanism that can rotate the belt 93 and the separating arm 92 in directions opposite to each other can be applied to various embodiments.

Figure 15:
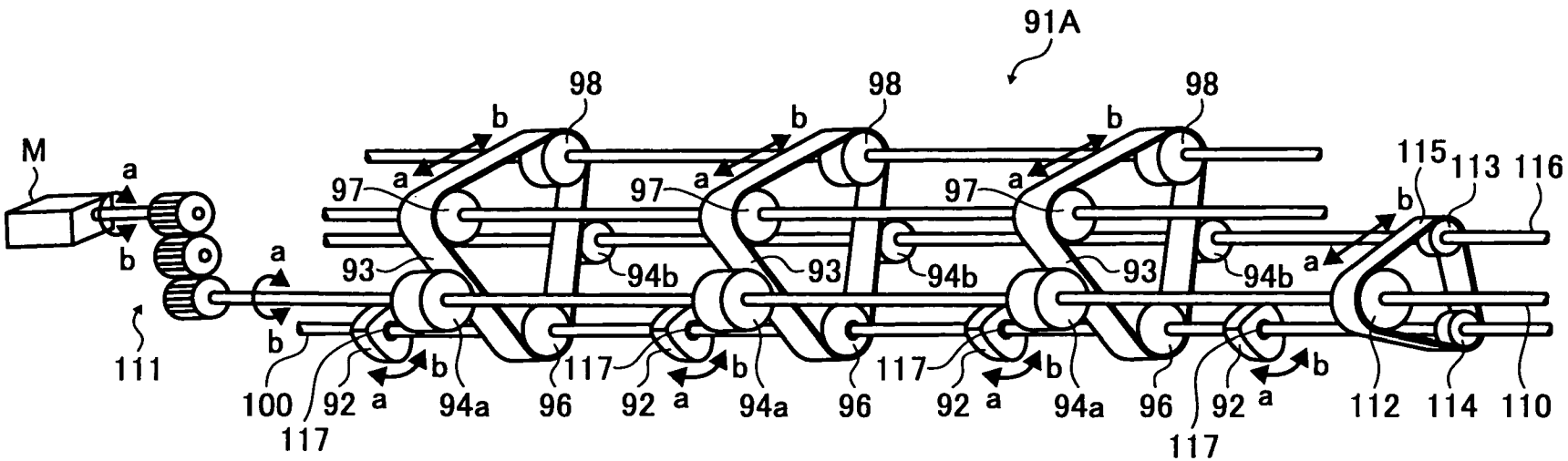
FIG. 15 is a perspective view showing a schematic configuration of a modification of the conveying path switching device.

FIG. 15 shows a schematic configuration of a modification of the conveying path switching device 91 according to the present embodiment. It should be noted that the size of the turn roller 94 is larger in a conveying path switching device 91A, and a turn roller 94*a* is in contact with the outer circumferential surface of the opposing belt 93. Hereinafter, only the differences between the conveying path switching device 91A and the conveying path switching device 91 shown in FIG. 12 are described.

The driving force of the turn roller 94*a* positioned in the near side in the figure (on the conveying path 27 side) is transmitted from the belt driving section M to a gear 111 via a rotation axis 110. The rotation axis 110 is rotated in the right-handed or left-handed direction (direction of the arrow b in the figure) by the belt driving section M by means of the gear 111. Also, a turn roller 94*b* disposed on the far side in the figure (on the conveying path 28 side) is rotated in the same direction as the turn roller 94*a* via the rotation axis 110 of the turn roller 94*a* and a belt 115 extended around pulleys 112, 113 and 114.

The pulley 114 extending the belt 115 is supported by the rotation axis 100 supporting the separating arm 92 and roller 96. The separating arm 92 is rotated by the rotation of the belt 115 in the same direction as the rotation axis 110 via the pulley 114. Therefore, the belt 113 and the separating arm 92 can be rotated in the directions opposite to each other, whereby the recording sheet can be stably conveyed toward the conveying path 27 or 28. Furthermore, the separating arm 92 is provided with a torque limiter 117. When the position of the separating arm 92 is regulated the torque limiter 117 operates, and the load applied to the belt driving section M can be reduced. It should be noted in FIG. 15 that the position of the separating arm 92 is regulated by causing the area below the rotation axis of the separating arm 92 to abut on the conveying guide when the separating arm 92 is rotated in the right-handed or left-handed direction without providing the convex section in the upper section of the separating arm.

In such a configuration, the recording sheet that is introduced to the position of the separating arm 92 by the introducing path 26 is guided by a separating arm 112 to an abutment section between the turn roller 94 and the belt 93, and is conveyed toward the conveying path 27 or 28 by the forces of friction between the surface of the recording sheet and the turn roller 94 and belt 93.

Further, FIG. 15 describes that the roller 97 and the turn roller 94*a* are driven using the same belt driving section M, but the present invention is not limited to this embodiment. For example, the roller 97 and the turn roller 94*a* may be provided with different driving sections. Not only the roller 97 but also the roller 98 may be provided with a different driving section. Moreover, the turn roller 94*b* located in the far side may be provided with a driving section that is different from the one provided in the turn roller 94*b* in the near side.

Figure 16:
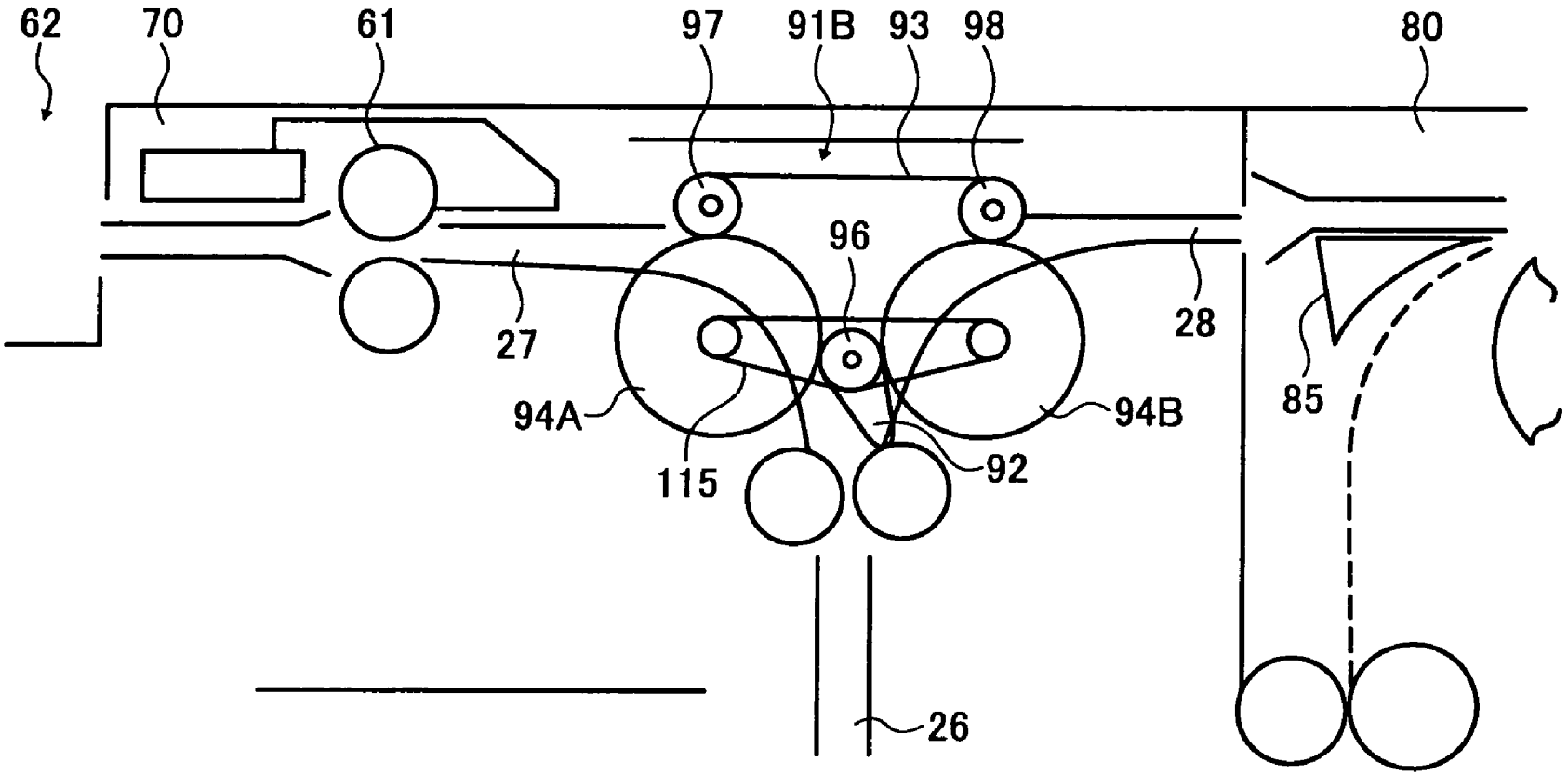
FIG. 16 is a cross-sectional view showing a schematic configuration of another modification of the conveying path switching device.

FIG. 16 shows a schematic configuration of another modification of the conveying path switching device 91. A conveying path switching device 91B shown in FIG. 16 has turn rollers 94A and 94B that are larger than the one provided in the conveying path switching device 91A shown in FIG. 15, has a deformed belt 93 abutting on the outer circumferential surface of the opposing belt 93. Hereinafter, only the differences between the conveying path switching device 91B and the conveying path switching device 91A shown in FIG. 15 are described.

In FIG. 16, the turn roller 94A disposed on the conveying path 27 side is configured to have a size so as to sandwich the belt 93 between the turn roller 94A and the roller 97 and between the turn roller 94A and the roller 96. The turn roller 94B disposed on the conveying path 28 side is similarly configured to have a size so as to sandwich the belt 93 between the turn roller 94B and the roller 98 and between the turn roller 94B and the roller 96. Therefore, as shown in FIG. 16, the belt 93 comes into contact with an outer circumference of the turn roller 94A between the rollers 96 and 97, and with an outer circumference of the turn roller 94B between the rollers 96 and 98, and two sides of the belt are deformed inward along the outer circumferences of the turn rollers 94A and 94B. In such a state, the dimension of the area of contact between the belt 93 and the recording sheet that has passed through the separating arm 92 increases, thus the recording sheet can be conveyed more stably toward the conveying path 27 or 28.

As described above, in the present embodiment, when the recording medium is conveyed to either one of the two conveying paths that are introduced from the introducing path, the leading edge of the recording medium is guided by the surface of the rotatable belt. Accordingly, when the leading edge of the recording medium comes into contact with the belt surface configuring the wall surfaces of the two conveying paths, the belt surface can be moved in the recording medium conveyance direction by the rotation of the belt. As a result, the conveyance load that is applied when the leading edge of the recording medium comes into contact with the wall surfaces of the two conveying paths can be reduced. Therefore, not only sheets of a fixed size that are normally used, but also highly rigid sheets and special sheets can be stably conveyed without causing a paper jam or conveyance failure. Moreover, by simply providing the belt that is extended to form a triangle, an easy-to-use sheet conveying path switching device can be provided in a small space, inhibiting the increase of the cost.

As described above, according to the present embodiment, the following effects can be obtained.

(1) The wall surfaces to which the leading edge of the recording sheet comes into contact at a section between the separating arm 92 and the two conveying paths 27 and 28 are configured to form the rotatable belt 93, whereby the friction resistance between the leading edge of the recording sheet and the belt can be reduced. Therefore, not only sheets of a fixed size that are normally used, but also highly rigid sheets and special sheets can be stably conveyed without causing a paper jam or conveyance failure.

(2) The belt 93 can be rotary driven in both normal and reverse directions by the belt driving section M, whereby the recording sheet conveying performance improves, and the recording sheet can be conveyed more stably.

(3) Also, the operation of switching the separating arm 92 is performed at the same time that the operation of switching the direction of rotation of the belt 93 is performed, whereby the recording sheet can be securely guided to different conveying paths.

(4) The turn roller 94 that is driven so as to sandwich and convey the recording sheet is disposed in the position facing the belt 93, whereby the friction resistance between the belt 93 and the recording sheet can be increased, the recording sheet conveying performance improves, and the recording sheet can be conveyed more stably.

(5) Furthermore, by providing the torque limiter in the belt driving section M, the direction of rotation of the belt 93 can be securely switched so that the recording sheet is conveyed to different conveying paths.

(6) Moreover, the turn roller 94 is composed of a sliding member, whereby the risk of the occurrence of rubbing and the like between the turn roller and the recording sheet can be lowered.

(7) In addition, by using an electrically conductive member as the material of the belt 93, frictional electrification can be prevented from occurring at the abutment surface between the belt and the recording sheet. Particularly an abnormal image that may be caused by the frictional electrification when performing printing on the second side can be prevented from being generated.

Various modifications will become possible for those skilled in the art after receiving the teachings of the present disclosure without departing from the scope thereof.

The present patent application claims priority under 35 U.S.C. sctn. 119 upon Japanese patent applications No. 2006-148818, filed on May 29, 2006, No. 2006-270578, filed on Oct. 2, 2006, and No. 2007-032869, filed on Feb. 14, 2007, the content of each of which is hereby incorporated by reference herein in its entirety.

What is claimed is:

1. A sheet conveying path switching device, comprising:

a switching separating arm;

at least one movable belt surface, downstream of the switching separating arm, configured to rotate in at least one of a normal and reverse direction;

a first sheet guide to convey a sheet toward the switching separating arm;

a second sheet guide to convey the sheet in a direction different from the first sheet guide;

a third sheet guide positioned downstream of the switching separating arm, wherein the switching separating arm is configured to convey the sheet to the at least one movable belt surface via the third sheet guide, and the at least one moveable belt surface is configured to contact the outer surface of the sheet and the third sheet guide is configured to form a pivot point on the inner surface of the sheet.

2. The sheet conveying path switching device as claimed in claim 1, wherein the third sheet guide is rotating members that respectively face belt extending rotating members for extending the at least one movable belt a sheet is sandwiched between the opposing rotating members and a surface of the at least one movable belt wrapped around the belt extending rotating members, and the sheet is then conveyed.

3. The sheet conveying path switching device as claimed in claim 2, wherein by driving the opposing rotating members, the at least one movable belt can be driven normally and reversely.

4. The sheet conveying path switching device as claimed in claim 2, wherein each of the opposing rotating members is provided with a torque limiter.

5. The sheet conveying path switching device as claimed in claim 1, wherein the switching separating arm includes a fixed guiding section and an end switching arm piece that is movable.

6. The sheet conveying path switching device as claimed in claim 5, wherein a base section of the fixed guiding section is brought as close as possible to the at least one movable belt surface.

7. The sheet conveying path switching device as claimed in claim 1, wherein the at least one movable belt surface is a single endless belt that comprises a plurality of belt sections that are divided in a direction perpendicular to a sheet conveyance direction.

8. The sheet conveying path switching device as claimed in claim 5, wherein a base section of the fixed guiding section is closer to the at least one movable belt than the at least one movable belt surface that conveys the lending edge of the sheet.

9. The sheet conveying path switching device as claimed in claim 1, wherein the at least one movable belt surface is a single endless belt and switching the position of the switching separating arm is performed prior to switching the direction of rotation of the at least one movable belt.

10. The sheet conveying path switching device as claimed in claim 1, wherein the at least one movable belt surface is a rotatable single belt that is extended to form the shape of a triangle, and the lending edge of the sheet contacts the at least one moveable belt surface.

11. The sheet conveying path switching device as claimed in claim 10, wherein the at least one movable belt surface constitutes a driving section that enables the at least one movable belt surface to rotate in normal and reverse directions.

12. The sheet conveying path switching device claimed in claim 11, wherein switching the position of the switching separating arm is performed at the same time that switching the direction of rotation of the single belt is performed.

13. The sheet conveying path switching device as claimed in claim 12, wherein a turn roller that is driven so as to hold the sheet with the at least one movable belt surface and convey the sheet is disposed in a position facing the belt.

14. An image forming apparatus including the sheet conveying path switching device of claim 1.

15. The sheet conveying path switching device as claimed in claim 1, wherein the at least one moveable belt surface is further configured to convey the leading edge of the sheet from the third sheet guide to the second sheet guide.

16. A sheet conveying path switching device, comprising:

a switching separating arm;

at least one moveable belt surface, downstream of the switching separating arm, configured to rotate in at least one of a normal and reverse direction;

a first sheet guide to convey a sheet toward the switching separating arm;

a second sheet guide to convey the sheet in a direction different from the first sheet guide;

a third sheet guide positioned downstream of the switching arm, wherein the switching separating arm is configured to convey the sheet to the at least one moveable belt surface via the third sheet guide, and the at least one moveable belt surface is a single endless belt that includes a plurality of belt sections that are divided in a direction perpendicular to a sheet conveyance direction.

17. An image forming apparatus including a sheet conveying path switching device, said sheet conveying path switching device comprising:

a switching separating arm;

at least one moveable belt surface, downstream of the switching separating arm, configured to rotate in at least one of a normal and reverse direction;

a first sheet guide to convey a sheet toward the switching separating arm;

a second sheet guide to convey the sheet in a direction different from the first sheet guide;

a third sheet guide positioned downstream of the switching separating arm, wherein the switching separating arm is configured to convey the sheet to the at least one moveable belt surface via the third sheet guide, and the at least one moveable belt surface is a single endless belt that includes a plurality of belt sections that are divided in a direction perpendicular to a sheet conveyance direction.

18. A sheet conveying path switching device, comprising:

a switching separating arm;

at least one moveable belt surface, downstream of the switching separating arm, configured to rotate in at least one of a normal and reverse direction;

a first sheet guide to convey a sheet toward the switching separating arm;

a second sheet guide to convey the sheet in a direction different from the first sheet guide;

a third sheet guide positioned downstream of the switching separating arm, wherein the switching separating arm is configured to convey the sheet to the at least one moveable belt surface via the third sheet guide, and the at least one moveable belt surface is a single endless belt and switching the position of the switching separating arm is performed prior to switching the direction of rotation of the at least one moveable belt.

19. An image forming apparatus including a sheet conveying path switching device, said sheet conveying device comprising:

a switching separating arm;

at least one moveable belt surface, downstream of the switching separating arm, configured to rotate in at least one of a normal and reverse direction;

a first sheet guide to convey a sheet toward the switching separating arm;

a second sheet guide to convey the sheet in a direction different from the first sheet guide;

a third sheet guide positioned downstream of the switching separating arm, wherein the switching separating arm is configured to convey the sheet to the at least one moveable belt surface via the third sheet guide, and the at least one moveable belt surface is a single endless belt and switching the position of the switching separating arm is performed prior to switching the direction of rotation of the at least one moveable belt.

* * * * *